US010995751B2

(12) United States Patent
Chu

(10) Patent No.: US 10,995,751 B2
(45) Date of Patent: May 4, 2021

(54) LOBE GEAR PUMP WITH INDUCER ASSEMBLY AND CENTRIFUGAL PUMP HAVING ONE FLUID FLOW PATH

(71) Applicant: PMC LIQUIFLO EQUIPMENT CO., INC., Garwood, NJ (US)

(72) Inventor: Yu-Sen J. Chu, Westlake, OH (US)

(73) Assignee: PMC LIQUIFLO EQUIPMENT CO., INC., Garwood, NJ (US)

( * ) Notice: Subject to any disclaimer, the term of this patent is extended or adjusted under 35 U.S.C. 154(b) by 323 days.

(21) Appl. No.: 15/744,999

(22) PCT Filed: Oct. 7, 2016

(86) PCT No.: PCT/US2016/055943

§ 371 (c)(1),
(2) Date: Jan. 15, 2018

(87) PCT Pub. No.: WO2017/066091

PCT Pub. Date: Apr. 20, 2017

(65) Prior Publication Data

US 2018/0209418 A1 Jul. 26, 2018

Related U.S. Application Data

(60) Provisional application No. 62/240,273, filed on Oct. 12, 2015.

(51) Int. Cl.
*F04C 2/26* (2006.01)
*F04C 15/00* (2006.01)
(Continued)

(52) U.S. Cl.
CPC ..... *F04C 2/126* (2013.01); *F04C 2/084* (2013.01); *F04C 11/005* (2013.01);
(Continued)

(58) Field of Classification Search
CPC .. F04C 11/005; F04C 11/008; F04C 15/0015; F04C 15/0019; F04C 2/084; F04C 2/126;
(Continued)

(56) References Cited

U.S. PATENT DOCUMENTS 3,642,384 A * 2/1972 Huse ..... F04C 19/00 417/205
3,918,852 A * 11/1975 Carter ..... F04D 7/06 417/423.12

(Continued)

FOREIGN PATENT DOCUMENTS

CN 2117479 U 9/1992
CN 2228564 Y 6/1996

(Continued)

OTHER PUBLICATIONS

International Search Report and Written Opinion for corresponding Patent Application No. PCT/US2016/055943 dated Jan. 10, 2017.

*Primary Examiner* — Mary Davis
*Assistant Examiner* — Paul W Thiede
(74) *Attorney, Agent, or Firm* — Renner, Otto, Boisselle & Sklar, LLP

(57) ABSTRACT

A high speed, rotary lobe gear pump assembly is provided which combines a positive displacement lobe gear pump having wipers with a centrifugal pump utilizing an impeller. The centrifugal pump feeds high pressure fluid flow directly into the lobe gear pump allowing the gear pump to rotate at high speeds without cavitation. The high speed capability of the pump assembly allows the lobe gear pump to operate without speed reduction gearing for the motor shaft.

16 Claims, 30 Drawing Sheets

(51) Int. Cl.

| | |
|---|---|
| ***F04C 11/00*** | (2006.01) |
| ***F04C 2/08*** | (2006.01) |
| ***F04D 7/02*** | (2006.01) |
| ***F04D 17/08*** | (2006.01) |
| ***F04C 2/12*** | (2006.01) |

(52) U.S. Cl.
CPC ..... *F04C 11/008* (2013.01); *F04C 15/0015* (2013.01); *F04C 15/0019* (2013.01); *F04D 7/02* (2013.01); *F04D 17/08* (2013.01)

(58) Field of Classification Search
CPC . F04D 17/08; F04D 7/02; F04D 13/00; F04D 13/12; F04B 35/00; F04B 23/00; F04B 23/08; F16C 32/0659
USPC ..... 418/201.2, 206.2, 206.5, 206.8; 417/310, 417/405, 199.1, 200, 201, 204–205; 415/111, 112
See application file for complete search history.

(56) References Cited

U.S. PATENT DOCUMENTS 4,570,849 A * 2/1986 Klaucke ..... F01P 7/044 236/35
4,629,904 A * 12/1986 Rojo, Jr. ..... F03B 13/086 290/1 R
4,925,372 A * 5/1990 Hansen ..... F02C 7/22 417/310
4,928,641 A * 5/1990 Niizato ..... F01L 1/053 123/196 M
5,363,740 A * 11/1994 Coakley ..... F01B 3/00 417/204
5,545,014 A * 8/1996 Sundberg ..... F01C 21/0863 417/204
6,007,311 A * 12/1999 Cygnor ..... F16C 32/0659 417/405
6,022,197 A * 2/2000 Cygnor ..... F02C 7/236 417/203
6,053,717 A * 4/2000 Dixon ..... F01C 21/0845 418/1
9,062,675 B2 * 6/2015 Dixon ..... F04C 2/084
2003/0080644 A1 * 5/2003 Nelson ..... H02K 7/14 310/196
2005/0232784 A1 10/2005 Yates et al.
2009/0044770 A1 * 2/2009 Scott ..... F01L 1/3442 123/90.17
2009/0045587 A1 * 2/2009 DeAngelis ..... F01L 1/3442 277/500
2010/0266437 A1 10/2010 Martin-Dye
2013/0216417 A1 8/2013 Dixon et al.
2014/0356197 A1 * 12/2014 Hotovec ..... F04B 23/04 417/300
2015/0285248 A1 10/2015 Dixon et al.

FOREIGN PATENT DOCUMENTS

CN 203321825 U 12/2013
EP 1 589 226 A1 10/2005

* cited by examiner

FIG. 6C
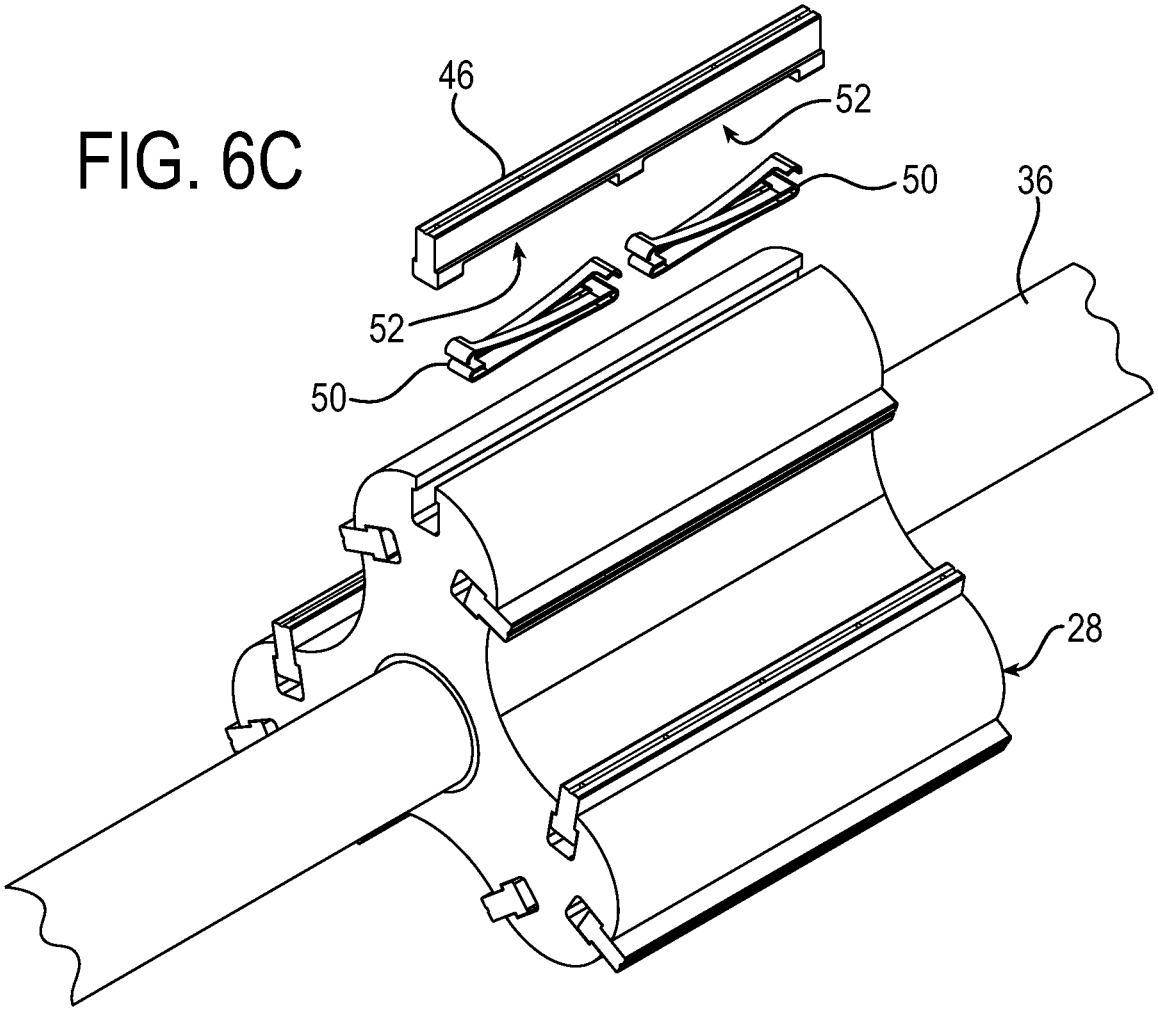
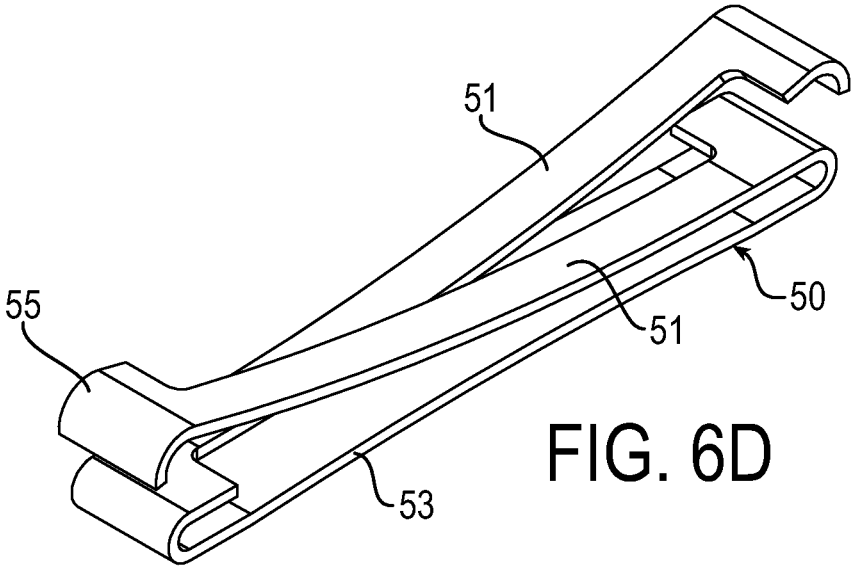
FIG. 6D

FIG. 29
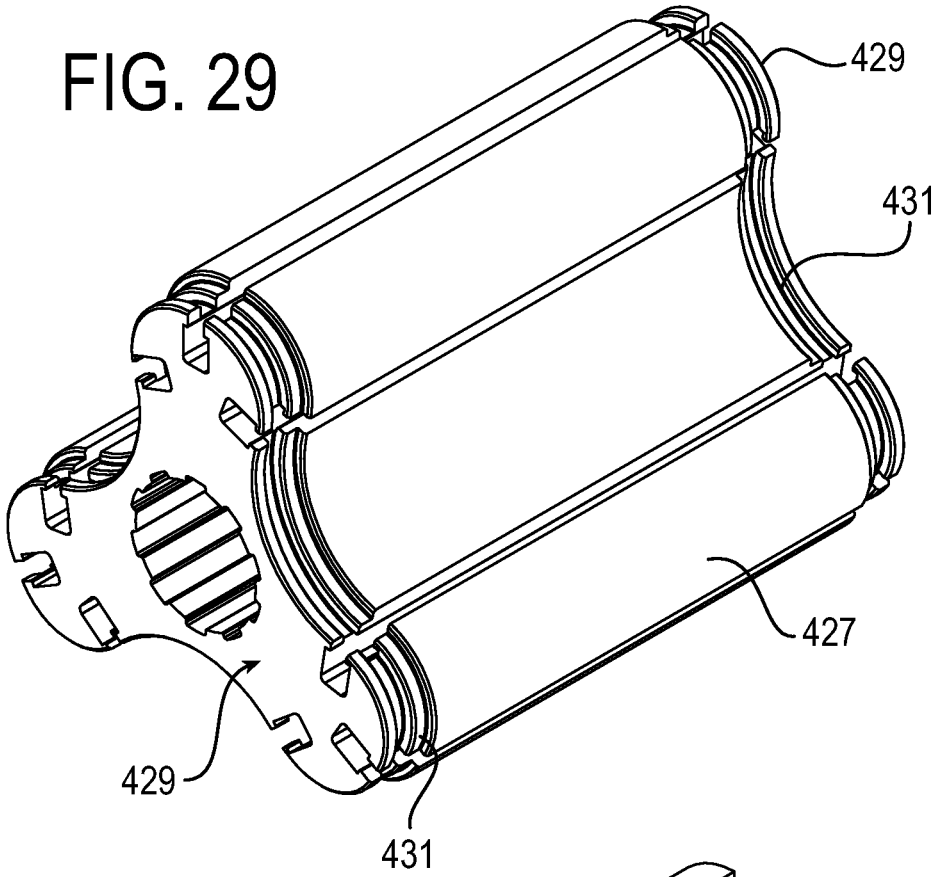
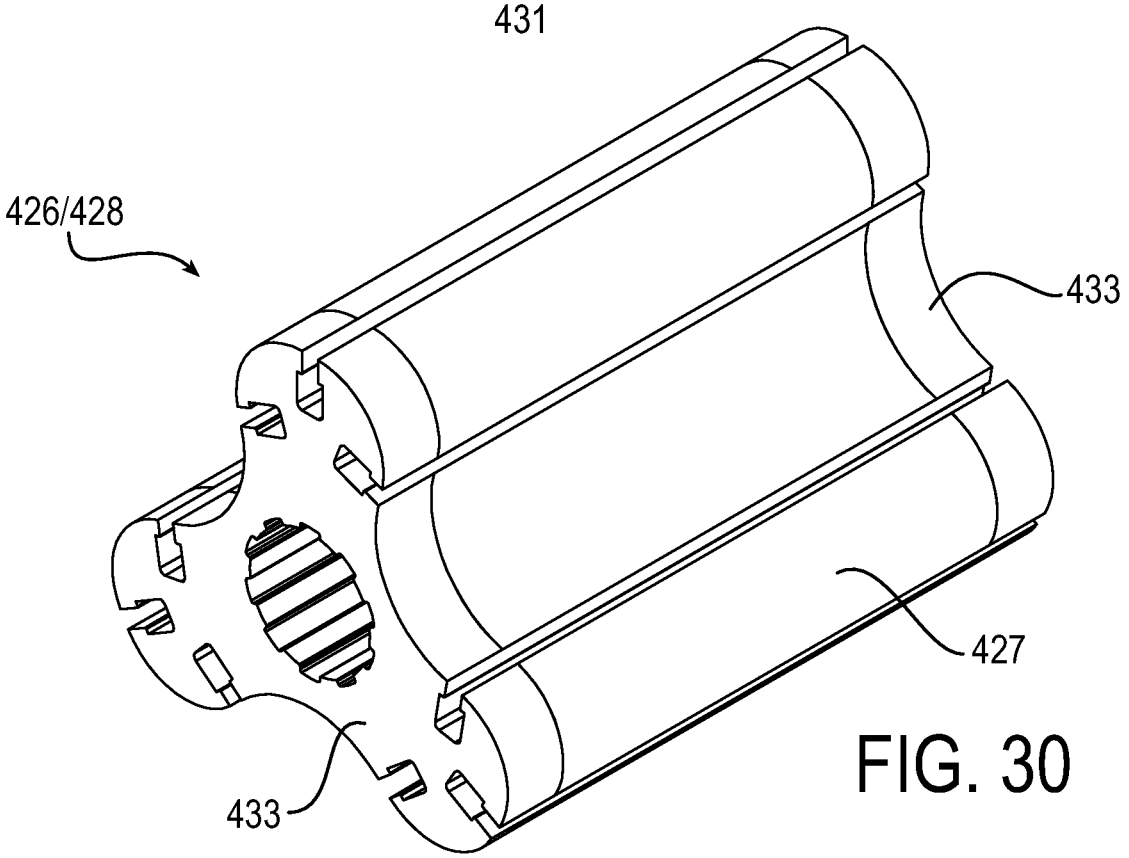
FIG. 30

LOBE GEAR PUMP WITH INDUCER ASSEMBLY AND CENTRIFUGAL PUMP HAVING ONE FLUID FLOW PATH

CROSS REFERENCE TO RELATED APPLICATIONS

The present application claims priority to International Patent Application No. PCT/US2016/055943 filed Oct. 7, 2016, which claims the benefit of the filing date of U.S. Provisional Patent Application Ser. No. 62/240,273, filed Oct. 12, 20156, the disclosures of which are incorporated herein by reference in their entirety.

TECHNICAL FIELD

The present invention relates to a rotary lobe gear pump that is particularly suited for pumping large amounts of low viscosity fluid at high speed.

BACKGROUND

Rotary lobe gear pumps are rotating, fixed volume, positive displacement pumps which utilize a pair of rotors each formed with a plurality of lobes. Lobe gear pumps have particular application in pumping shear-sensitive products because the rotating lobes of the rotors do not engage one another during operation. Lobe gear pumps use timing gears to eliminate contact between the rotors, which allows shear sensitive fluids to be pumped with minimal shear forces imposed on the fluids by the rotors. For fluids that do not contain large solids and that are not as shear sensitive, lobe gear pumps may utilize spring loaded wiper blades consisting of one or more wiper inserts that depressibly project outward from each rotor lobe to contact the adjacent rotor and the walls of the pump housing. The wiper blades provide increased efficiency by eliminating the clearance gaps by making a seal between the rotors and between the rotors and the walls of the pump housing.

Even with the improvement provided by the wiper blades, lobe gear pumps generally handle low viscosity liquids with diminished performance. The loading characteristics of lobe gear pumps are not as good as other positive displacement pump designs, and suction ability is low or moderate. The prior art wiper inserts and leaf springs are not durable enough for the high speed applications. These and other factors have prevented the use of lobe gear pumps in high speed fluid transfer applications. The low operating speeds of the lobe gear pump require a gear box to reduce the speed of the driving motor to a rotational speed utilizable by the lobe gear pump. This results in additional cost and a larger footprint for the pumping system. Accordingly, there remains a need in the art for a high speed lobe gear pump which overcomes one or more of these deficiencies.

SUMMARY

At least one embodiment of the invention provides a pump assembly comprising: a first housing having an interior chamber, an inlet, and an outlet; a first rotor and a second rotor, each rotor having a plurality of lobes, the first rotor and second rotor rotatable within the interior chamber of the first housing; a timing gear associated with the first and second rotor which causes the rotors to mesh upon rotation without contacting each other; a wiper insert interconnected to each of the plurality of lobes of each rotor, each wiper insert being depressibly radially biased outward from the lobe of the rotor such that the wiper can contact the at least one of the other rotor and the interior chamber of the first housing upon rotation of the rotors; a second housing attached to the first housing and having an interior chamber, an inlet, and an outlet fluidly connected to the inlet of the first housing; an impeller rotatable within the interior chamber of the second housing.

At least one embodiment of the invention provides a pump assembly comprising: a drive motor driving a first drive shaft; a first timing gear mounted on and coupled to the first drive shaft; a second timing gear driven by the first timing gear and mounted on and coupled to a second driven shaft; a lobe gear pump comprising a lobe gear housing having an interior chamber, an inlet, and an outlet, a first rotor and a second rotor, each rotor having a plurality of lobes, the first rotor and second rotor rotatable within the interior chamber of the lobe gear housing without contacting each other, a wiper insert interconnected to each of the plurality of lobes of each rotor, each wiper insert being depressibly radially biased outward from the lobe of the rotor such that the wiper can contact the at least one of the other rotor and the interior chamber of the first housing upon rotation of the rotors; and a centrifugal pump comprising a centrifugal pump housing attached to the lobe gear housing and having an interior chamber, an inlet, and an outlet, the outlet of the centrifugal pump housing fluidly connected to the inlet of the lobe gear housing, and an impeller mounted on and coupled to the first drive shaft, the impeller rotatable within the interior chamber of the centrifugal pump housing.

At least one embodiment of the invention provides a pump assembly comprising: a drive motor rotatably driving a first drive shaft in a first direction or a second direction; a first timing gear mounted on and coupled to the first drive shaft; a second timing gear driven by the first timing gear and mounted on and coupled to a second driven shaft; a lobe gear pump housing having an interior chamber, an inlet, and an outlet; a first rotor and a second rotor, each rotor having a plurality of lobes, the first rotor and second rotor rotatable within the interior chamber of the lobe gear housing without contacting each other, the first rotor mounted on and coupled to the first drive shaft, the second rotor mounted on and coupled to the second drive shaft; a wiper insert interconnected to each of the plurality of lobes of each rotor, each wiper insert being depressibly radially biased outward from the lobe of the rotor such that the wiper can contact the at least one of the other rotor and the interior chamber of the lobe gear pump housing upon rotation of the rotors; and a centrifugal pump housing attached to the lobe gear pump housing and having an interior chamber, an inlet, and an outlet, the outlet of the centrifugal pump housing fluidly connected to the inlet of the lobe gear pump housing; an impeller mounted on and coupled to the first drive shaft, the impeller rotatable within the interior chamber of the centrifugal pump housing, the impeller configured to pressurize fluid and direct the fluid to the lobe gear pump inlet when the motor is rotating the drive shaft in a first direction; a first inducer mounted on and coupled to the first drive shaft, a second inducer mounted on and coupled to the second drive shaft, the inducers configured to pressurize fluid and direct the fluid to the lobe gear pump outlet when the motor is rotating the drive shaft in a second direction.

At least one embodiment of the invention provides a lobe gear rotor, wiper blade biasing member comprising: a continuous band of formed metal strip having a base portion between a pair of arm portions each extending from opposite sides of the base portion at an acute angle with base portion, the metal strip having a first width and a second width smaller than the first width, the base portion and each end of the metal strip formed at the first width and a portion of each arm portion formed at the second width, the arms crossing each other generally at a midpoint of each arm such that the arms form an "X".

BRIEF DESCRIPTION OF THE DRAWINGS

Embodiments of this invention will now be described in further detail with reference to the accompanying drawings, in which:

FIG. 6C is a partially exploded perspective view of the rotor assembly of FIG. 6A; FIG. 6D is a perspective view of a spring used to bias the wiper outward from the rotor assembly;

FIG. 29 is a is perspective view of an embodiment of a rotor body used in a rotor assembly shown in FIG. 30; and FIG. 30 is a is perspective view of an embodiment of a rotor assembly having ends molded over the rotor body that enable the rotor assembly to dry run in the pump assembly shown in FIG. 24.

DETAILED DESCRIPTION OF THE DRAWING

Figure 1:
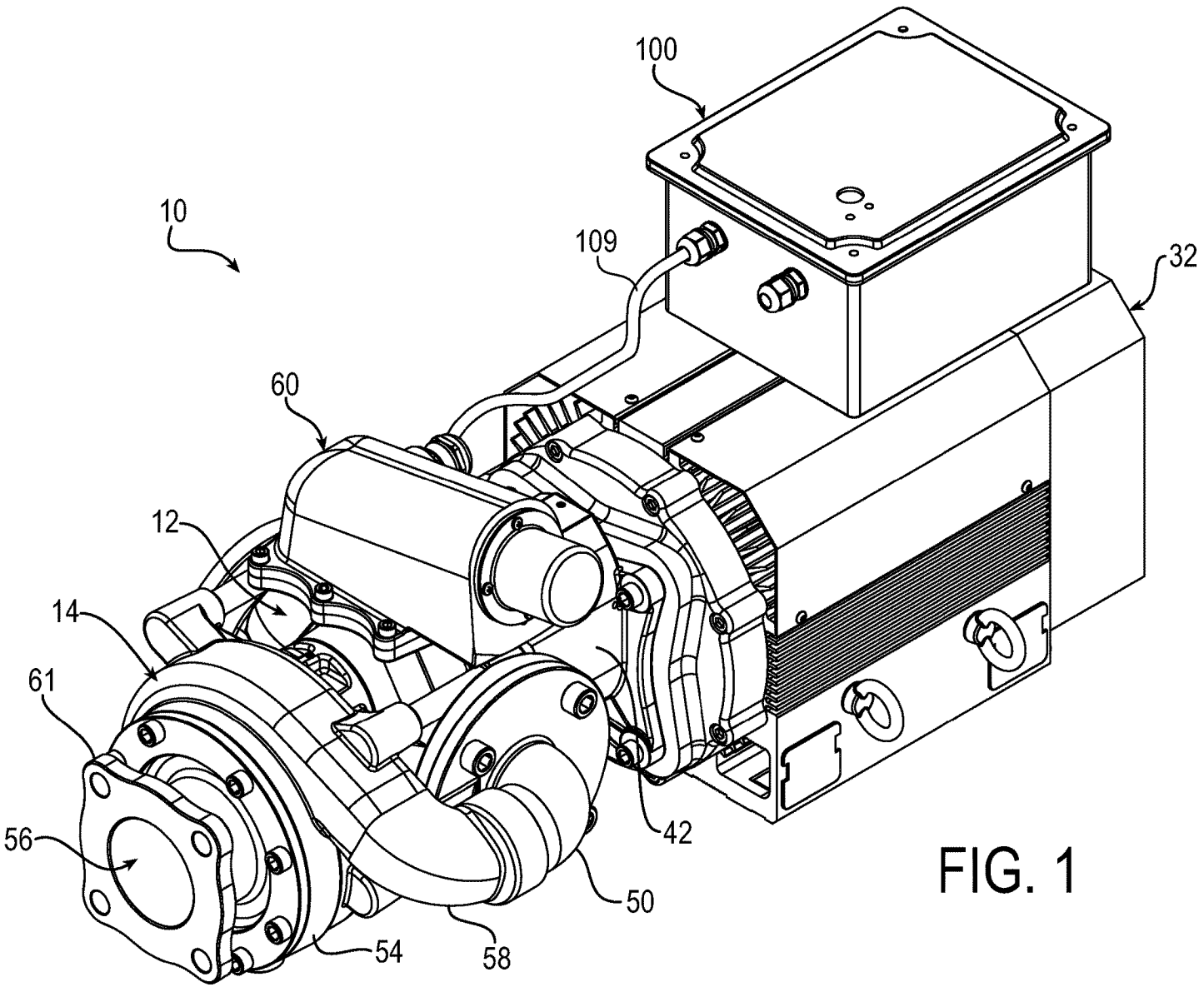
FIG. 1 is a perspective view of an embodiment of the pump assembly of the present invention.
Figure 2:
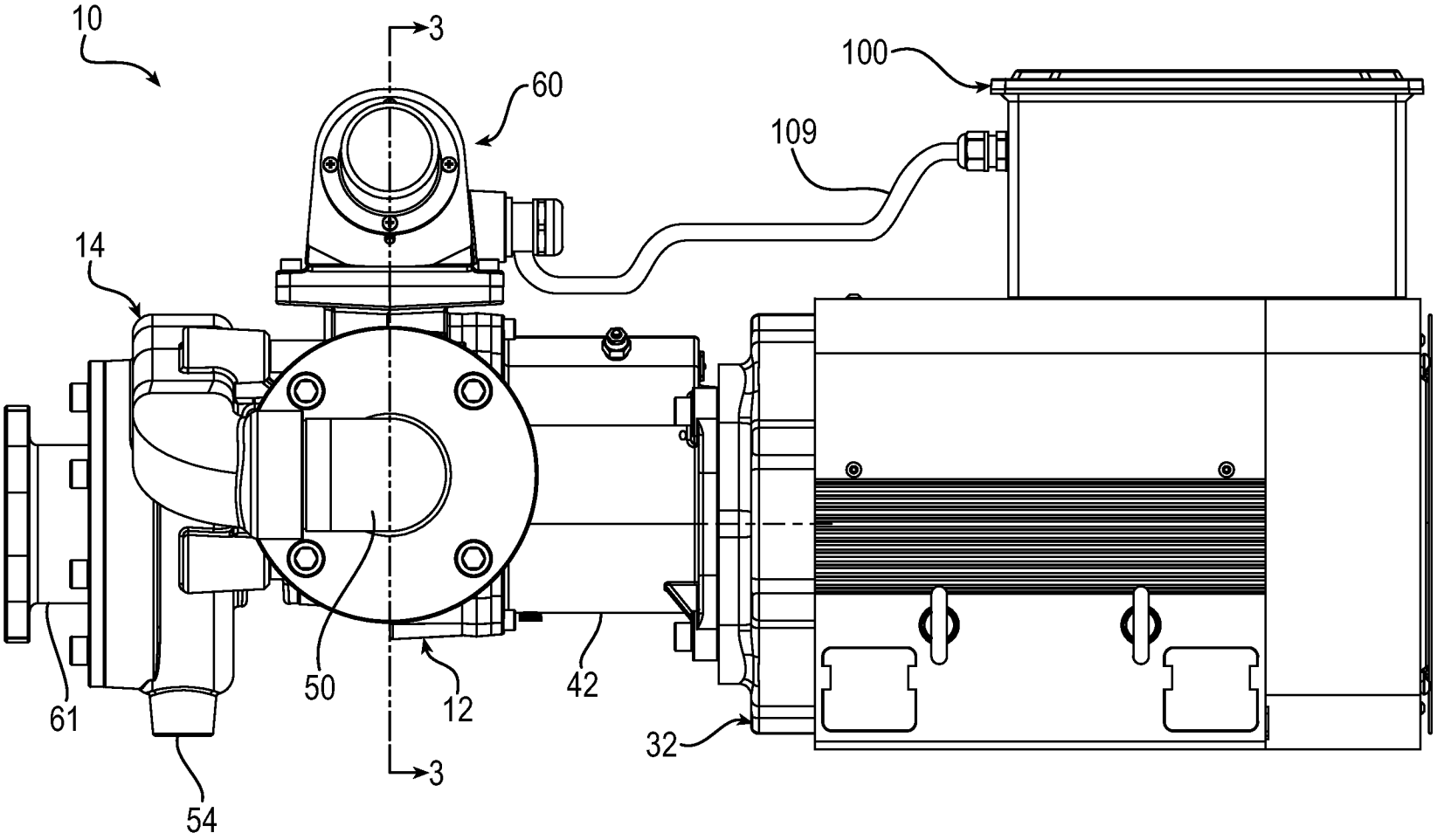
FIG. 2 is a side view of the pump assembly shown in FIG. 1.

FIGS. 1-5 illustrate an embodiment of the pump assembly 10 of the invention shown in various views as described above. The pump assembly 10 comprises a lobe gear pump 12 and a centrifugal pump 14. The lobe gear pump 12 comprises a first housing (also referred to as a lobe gear housing) 18 having an interior chamber 20 between an inlet or suction port 22 and an outlet or discharge port 24. It is noted that the pump assembly 10 is reversible and that in such a case the inlet port 22 would act as an outlet and the outlet port 24 would act as an inlet. The lobe gear pump 12 further comprises a first rotor 26 and a second rotor 28 rotatably housed within the interior chamber 20 of the lobe gear housing 18. The pump assembly 10 may further include a drive motor 32 shown herein as an AC motor but any suitable drive motor such as a hydraulic motor or DC motor is contemplated. The drive motor 32 drives a first drive shaft 34 which counter rotatingly drives a second driven shaft 36 through a pair of timing gears 38, 40 each mounted on a respective shaft 34, 36. The drive shaft 34 may be directly driven by the drive motor 32 such that no speed reduction gearing is utilized. The timing gears 38, 40 are shown as herringbone gears having a high contact ratio and are housed in a timing gear housing 42. The timing gear housing 42 is secured to the housing of the motor 32 on one end and secured to the lobe gear housing 18 on the other end thereof. The timing gears 38, 40 may be made of any suitable material such as an alloy steel. The timing gears 38, 40 lie within an oil bath in the timing gear housing 42 in order to operate quietly and efficiently.

The first rotor 26 is mounted on the drive shaft 34 and the second rotor 28 is mounted on the driven shaft 36. The drive shaft 34 and driven shaft 36 are rotationally supported on either side of the rotors 26, 28 by bearings 44. The drive motor 32 creates torque and speed, which is transferred by the timing gears 38, 40. The timing gears 38, 40 provide the torque for the rotors 26, 28 as well as provide timing between the rotors 26, 28. It is contemplated that the drive shaft 34 and driven shaft 36 each may be manufactured as a single monolithic member or as a plurality of members.

Referring now to FIGS. 6A-6D, each rotor 26, 28 has a plurality of lobes 30. The plurality of lobes 30 of the rotors 26, 28 mesh with each other while the rotors 26, 28 counter rotate but do not make contact with each other due to the timing gears 38, 40. The rotors 26, 28 include a plurality of vanes or wiper blades 46 located on each lobe 30 that are designed to create a seal within the interior chamber 20 of the first housing 18. The wiper blades 46 help prevent fluid leak through the gaps in between the lobes 30 and between a lobe 30 and the walls 19 of the interior chamber 20. The wiper blades 46 may be manufactured from any suitable material such as a filled PEEK material that is both self-lubricating and durable. The wiper blades 46 come in contact with both the walls 19 of the interior chamber 20 and the opposite rotor 26, 28 and as a result must be durable enough to contact the rotors 26, 28 but also have self-lubricating properties so as not to create wear (see FIGS. 3 and 4) which allows the pump 10 to be continuously dry run without damaging the pump. The wiper blades 46 in addition to being designed with a highly durable material utilize several apertures 48 across the wiper blade 46 to promote further lubrication. The apertures 48 allow lubricant to fill these apertures 48 and create a better surface interaction thus reducing the wear on the wiper blade 46. The wiper blade 46 is biased outward from the lobes 30 by a spring 50 that keeps the wiper blade 46 in contact with the pump chamber walls 19 or the surface of a meshing lobe 30 to prevent leakage. In the embodiment shown, wiper blade 46 is shaped as an inverted "T" and retained in corresponding slots 31 in the rotors 26, 28 as is known in the art. The spring 50 is formed as an "X-spring" from any suitable material such as a tempered or hardened stainless spring steel. The spring 50 is formed from a continuous band having a pair of arms 51 extending from a base portion 53 of the spring and crossing each other generally at a midpoint of each arm such that the arms form an "X". Each of the pair of arms of the wiper blade spring 50 has a portion which is generally half the width of the base of the spring 50. The ends 55 of each of the pair of arms 51 of the wiper blade spring 50 are generally the same width of the base 53 of the spring 50. The configuration of the wiper insert spring 50 provides stability as it will not rock back and forth like prior art leaf springs.

Due to the design of the spring 50, the spring will not lose its spring force and will reduce the frequency of failure. The form of the spring 50 minimizes stress because the pressure is not focused on one point, but distributed evenly along the base. As a result, the wear life is increased and the spring 50 will retain its' spring force resulting in an efficient seal. One or more springs 50 may be used for each wiper blade 46. The springs 50 may be inserted into slots 52 in the base of the wiper blade 46 to help retain the spring in the rotor 26, 28.

Referring again to FIGS. 1-5, the centrifugal pump 14 of the pump assembly 10 comprises a second housing (also referred to as a centrifugal pump housing) 54 attached to the lobe gear housing 18 and having an inlet 56 and an outlet 58. The inlet 56 is shown with an inlet flange 61 attached thereto. The outlet 58 of the centrifugal pump housing 54 is connected to the inlet 22 of the lobe gear housing 18 by a fluid connecting member 50 shown as an elbow flange. It is again noted that the pump assembly 10 is reversible and that in such a case the inlet port 56 would act as an outlet and the outlet port 58 would act as an inlet.

Figure 7A:
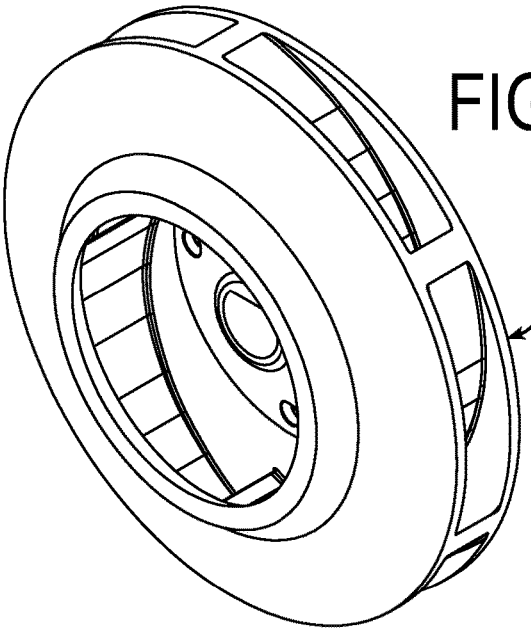
FIG. 7A is a perspective view of the impeller shown in FIG. 5.
Figure 7B:
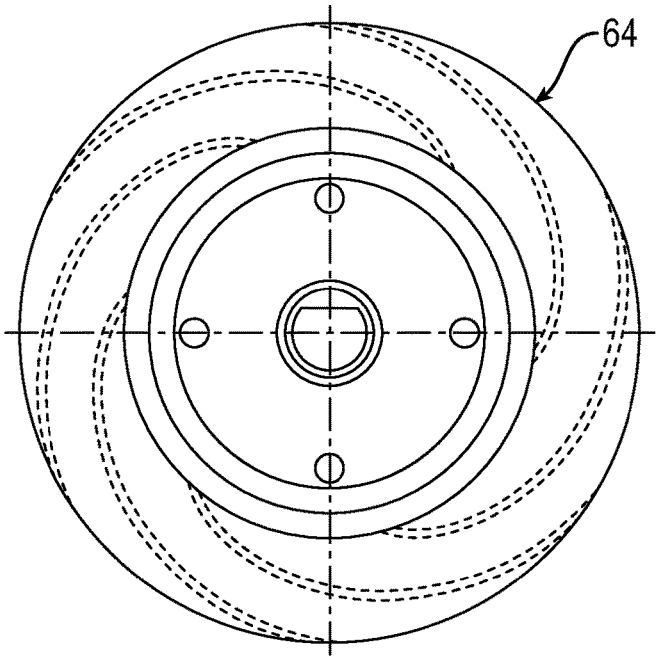
FIG. 7B is a front view of the impeller of FIG. 7A.
Figure 7C:
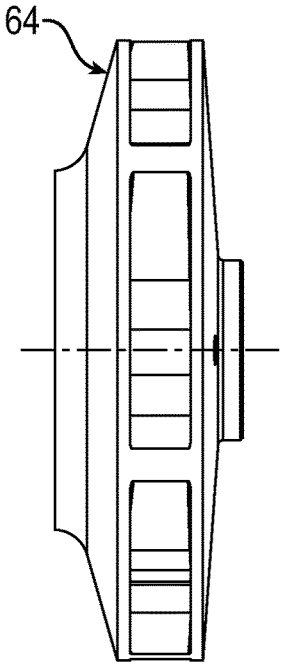
FIG. 7C is a side view of the impeller of FIG. 7A.

An impeller 64, shown in detail in FIGS. 7A-7C, is rotatably positioned in a shrouded portion of the centrifugal pump housing 54 and is mounted on and is rotationally driven by the drive shaft 34. The impeller 64 is made of any suitable material such as stainless steel which is durable and has the capability of handling vapor bubbles. The impeller blades are preferably optimized to be sharp, large, and smoothly machined to allow for faster acceleration of the fluid during rotation of the impeller 64. The impeller 64 allows for a quick acceleration of the fluid from the leading edge to the blade. The rotating impeller 64 acts as a centrifugal pump to pump fluid into the inlet 22 of the lobe gear housing 18. The rotation of the impeller 64 transfers energy from the drive motor 32 to the fluid being pumped by accelerating the fluid onwards from the center of rotation through the volute impeller outlet 58 and fluid connecting member 50 to the inlet 22 of the lobe gear housing 18. This results in the ability of the impeller 64 to establish the pressure boost to the rotors 26, 28 to pump more flow without resulting in cavitation. The use of the impeller 64 eliminates the need for a speed reduction gearbox by allowing the pump assembly 10 to run at high speeds (1800+ rpm) to generate higher flow than prior art lobe gear pumps.

Figure 3:
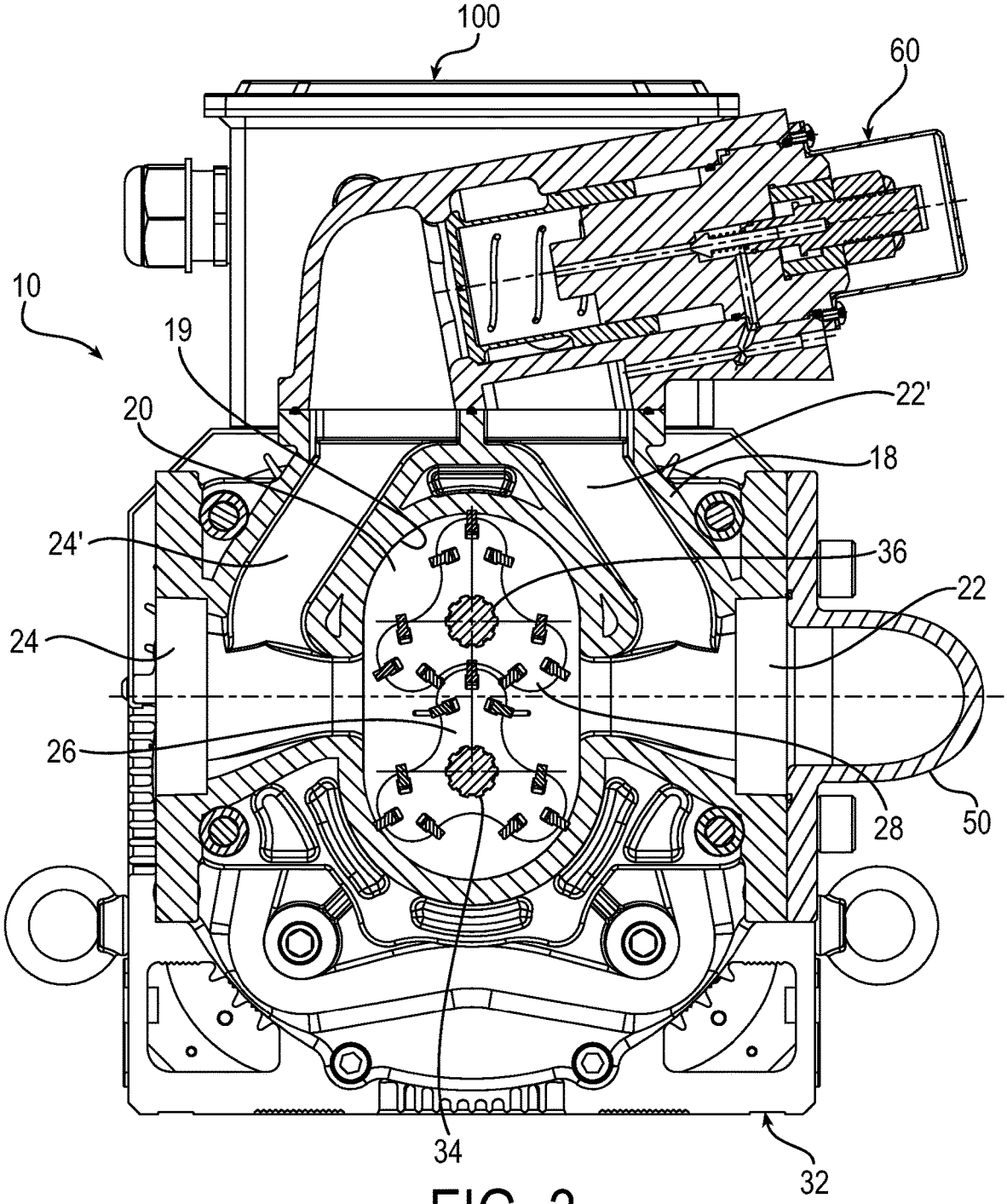
FIG. 3 is a sectional view of the pump assembly of FIG. 2.
Figure 4:
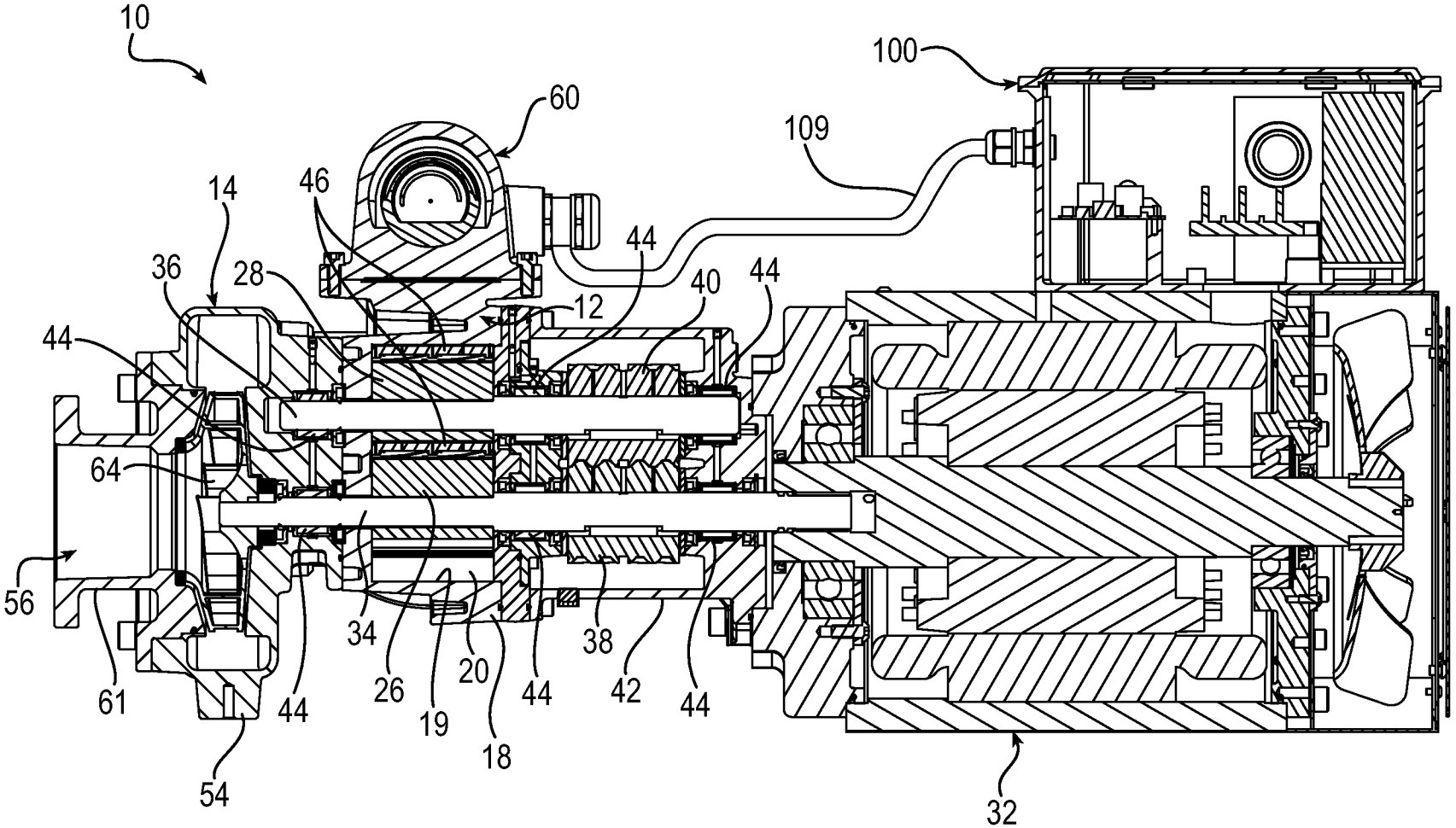
FIG. 4 is a sectional view of the pump assembly of FIG. 1 taken along the longitudinal centerline of the pump assembly.
Figure 5:
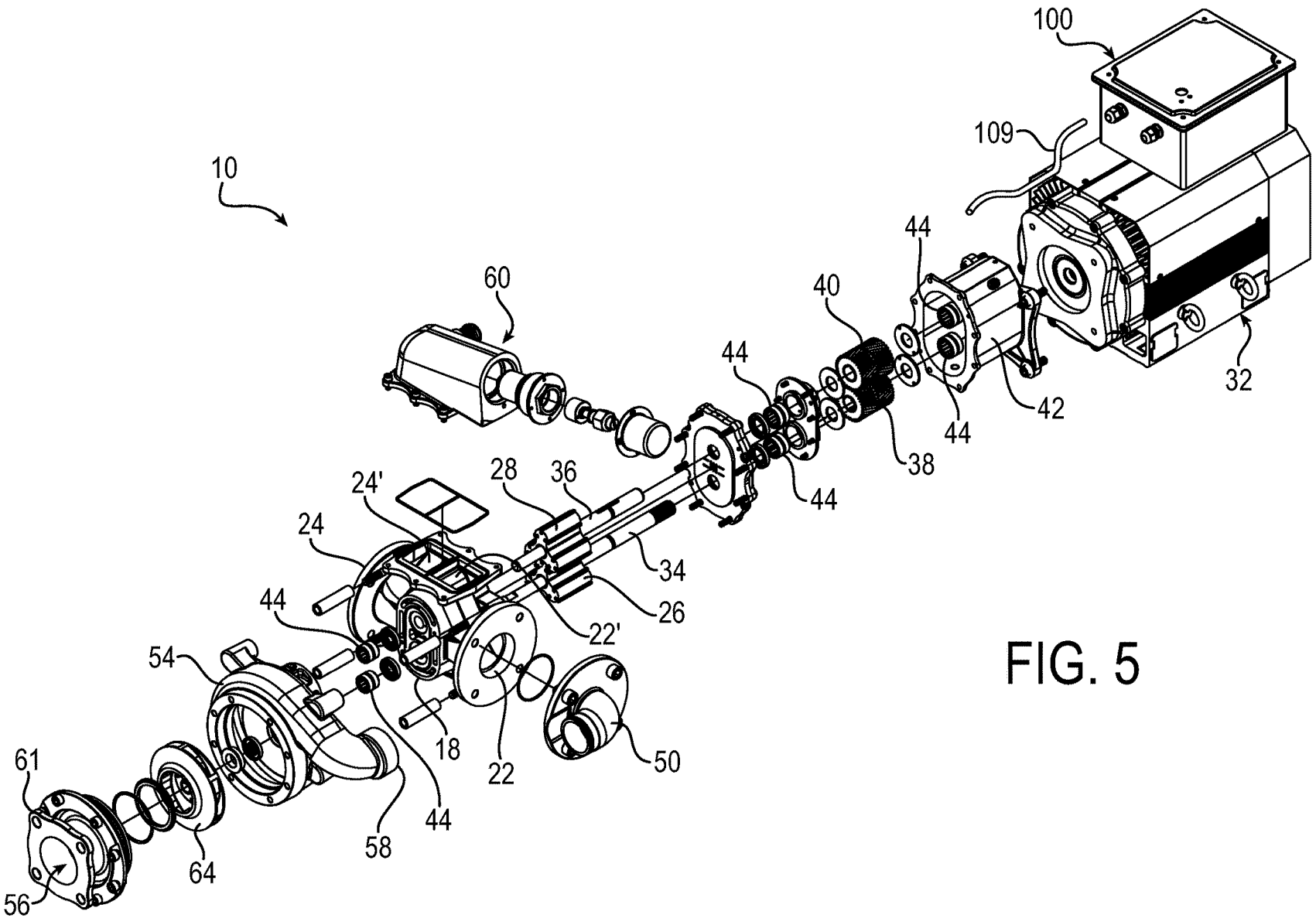
FIG. 5 is a exploded perspective view of the pump assembly of FIG. 1.
Figure 6A:
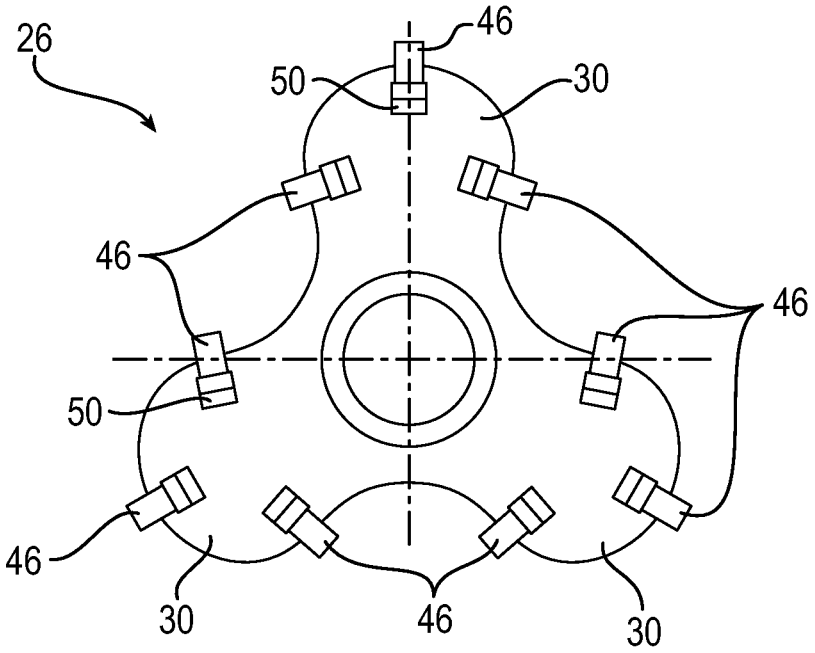
FIG. 6A is an end view of a rotor assembly shown in FIG. 5.
Figure 6B:
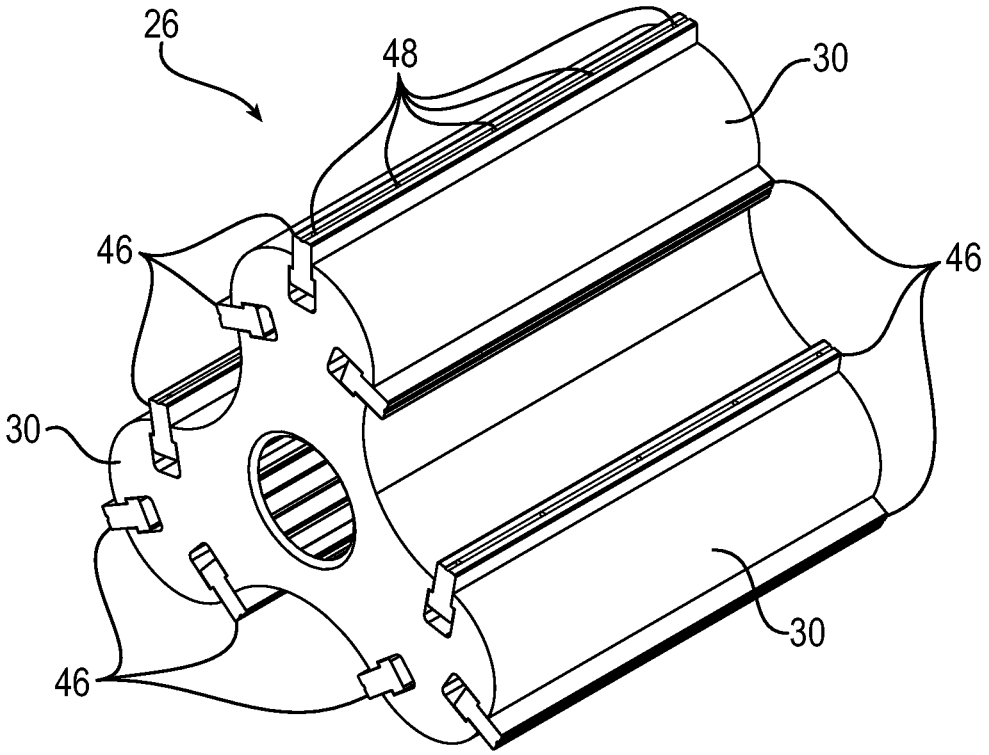
FIG. 6B is a perspective view of the rotor assembly of FIG. 6A.
Figure 8:
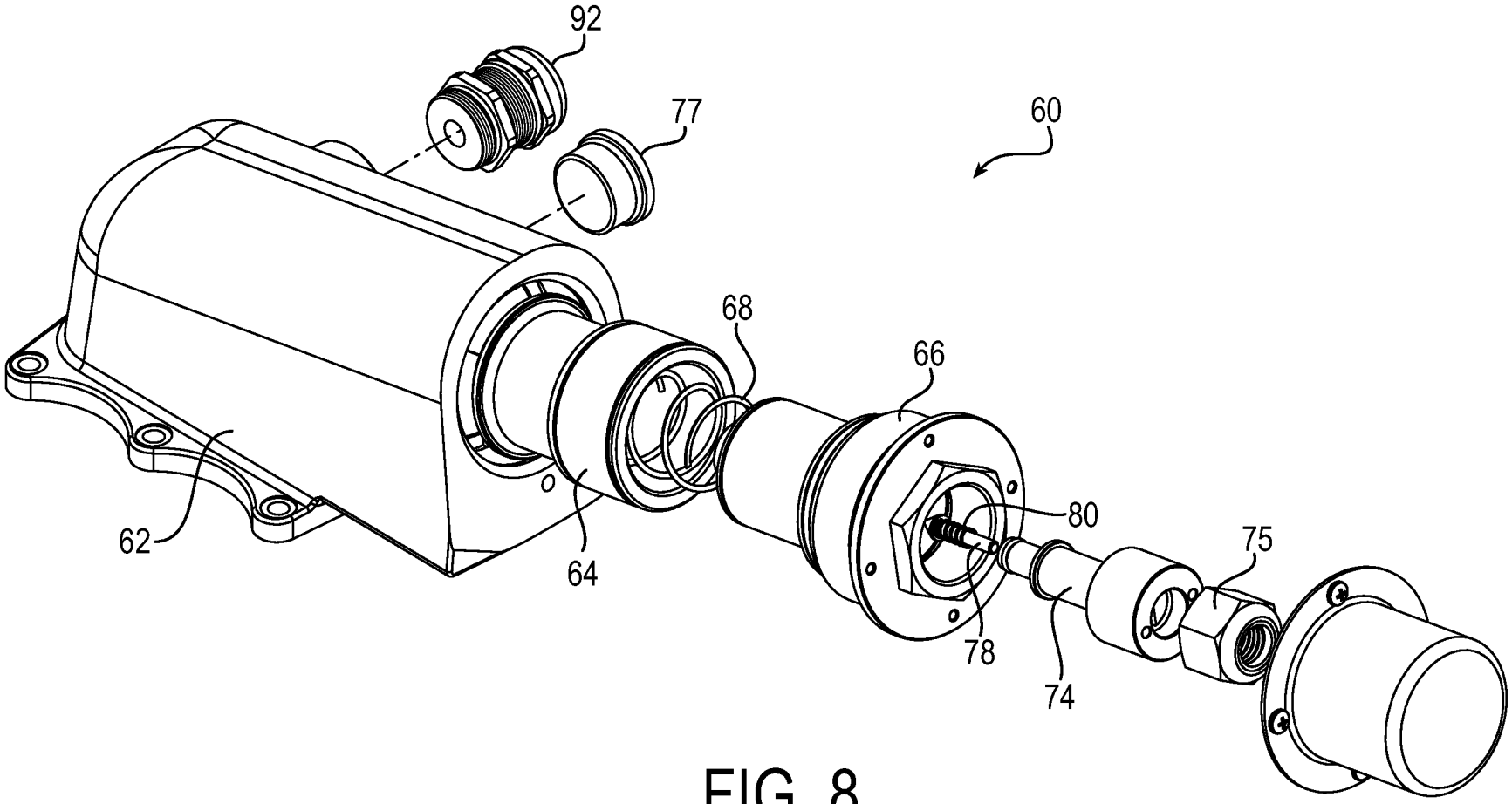
FIG. 8 is an exploded perspective view of the bypass assembly shown in FIG. 5.
Figure 9:
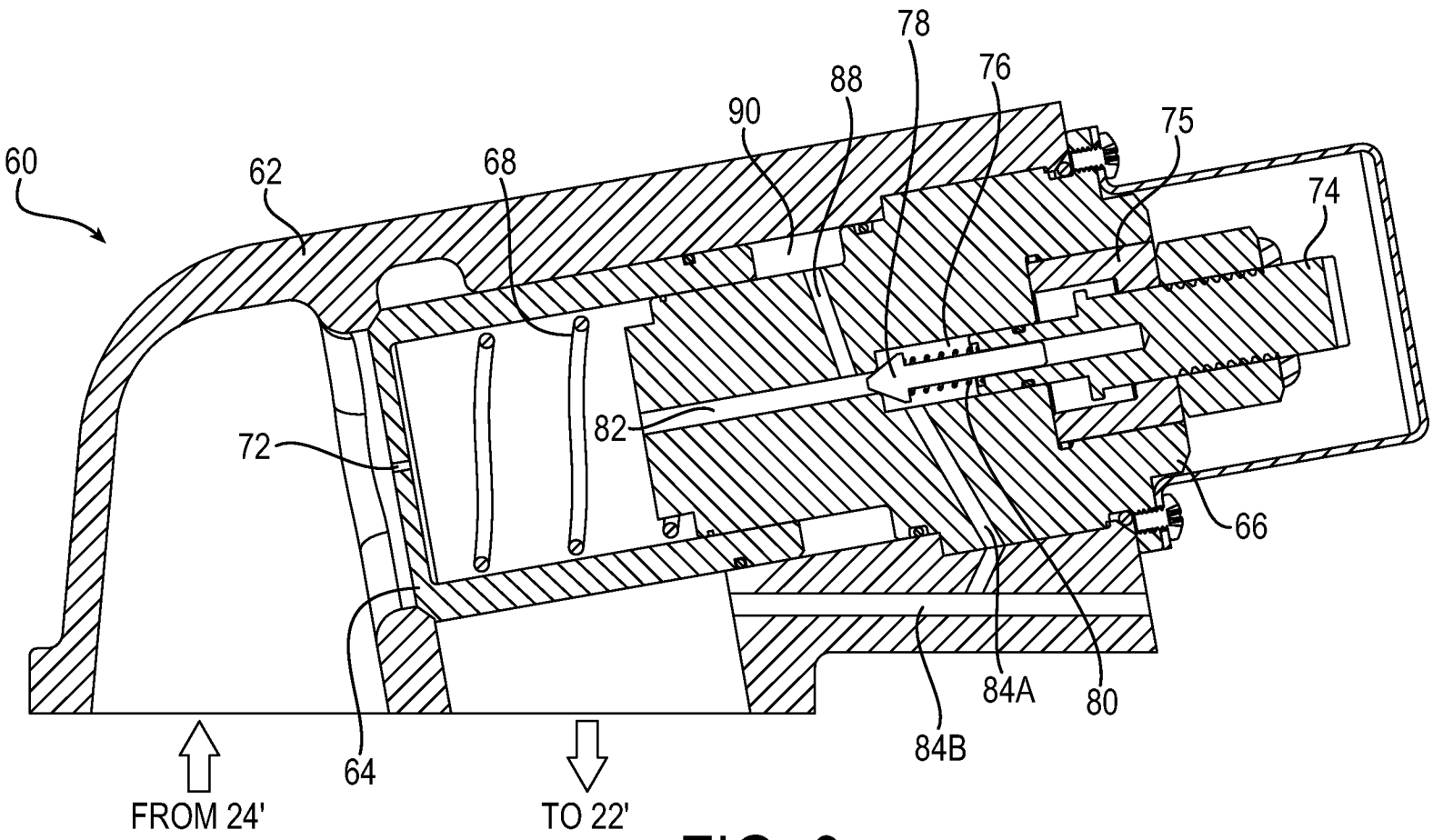
FIG. 9 is a sectional view of the bypass assembly of FIG. 8 taken along the longitudinal centerline of the bypass assembly.
Figure 10:
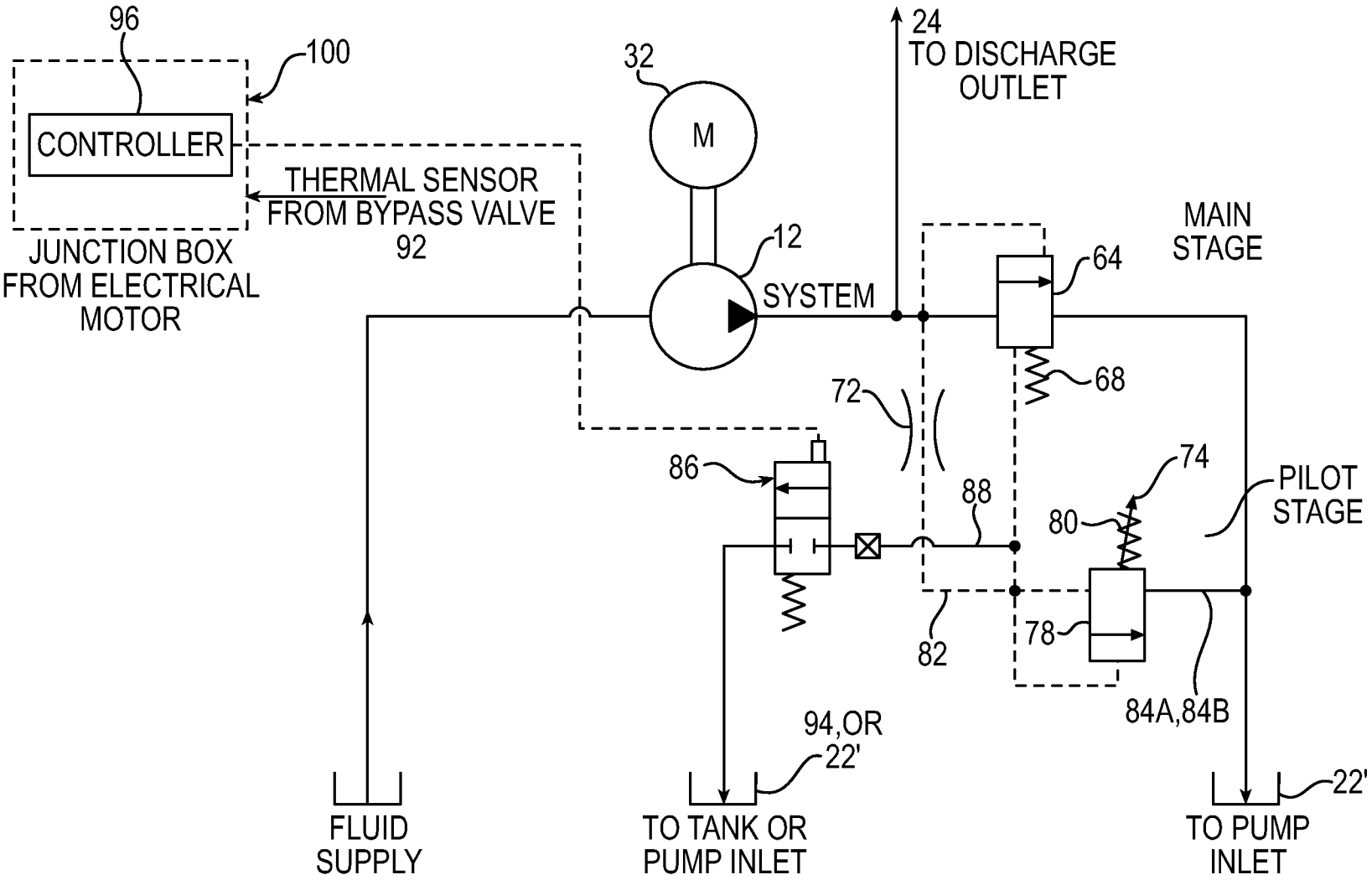
FIG. 10 is a schematic diagram showing the operation of the bypass valve of FIG. 8 with the pump assembly.

The pump assembly 10 optionally includes a pilot-operated bypass valve 60 to control pressure in the lobe gear pump chamber 20 by allowing high pressure fluid to be rerouted from the lobe gear pump outlet 24' back to the inlet 22' of the lobe gear pump chamber 20 as best shown in FIG. 3. The pilot-operated relief valve 60 is located above the inlet 22' and discharge or outlet ports 24' of the pump chamber 20. Referring now to FIGS. 8-10, the pilot-operated bypass valve 60 comprises a bypass valve housing 62 housing a main poppet 64. A cap 66 is threaded into an end of the bypass valve housing 62 such that an end of the cap 66 is inserted into an end of the main poppet 64. A main spring 68 engages the cap 66 and sealingly biases the main poppet 64 against a landing 70 in the bypass valve housing 62, preventing fluid flow through the bypass valve 60 from the discharge port 24' of the pump chamber 20.

The pilot-operated bypass valve 60 also comprises an orifice 72 through the main poppet 64. An adjustment member 74 is adjustably positioned by nut 75 to extend into a chamber 76 within the cap 66. A pilot poppet 78 is biased by a pilot spring 80, positioned between the pilot poppet 78 and an end of the adjustment member 74, to seal a pilot passageway 82 formed extending through the cap 66 to the chamber 76. The adjustment member 74 allows the pilot bypass pressure to be externally set at a predetermined pressure by the user by compressing or decompressing the pilot spring 80. A downstream pilot passageway 84A, 84B through the cap 66 and the bypass valve housing 62 fluidly connects the chamber 76 in the cap 66 to the inlet 22' of the lobe gear pump housing 18.

The pilot-operated bypass valve 60 operates in two stages, the pilot stage and the main stage. The main poppet 64 is normally closed. Due to the orifice 72 the fluid pressure within the main poppet 64 and the discharge pressure are generally the same. Once the pump discharge pressure exceeds the preset cracking pressure, the pilot poppet 78 will open and release the pressure trapped inside the main poppet 64. The fluid is released through the main orifice 72 and through the pilot passageway 82 and the downstream pilot passageway 84A, 84B, increasing pressure differential across the main poppet 64 and opening the main stage poppet 64.

This allows for large amounts of fluid to bypass from discharge 24' to the inlet 22'. The benefit of using a pilot-operated relief valve 60 instead of direct acting relief valve is that it provides less pressure override from cracking to full bypass. The cracking pressure can be adjusted easily to determine when the pump assembly 10 will run in bypass mode, allowing for better control to bypass large amounts of flow.

Alternatively, the bypass valve 60 has a vent feature incorporating a low flow solenoid valve 86. As shown, this feature comprises a vent flow passage 88 connecting the pilot passageway 82 to a vent chamber 90 between the cap 66 and the bypass housing 62. The solenoid valve 86 is controlled by a bypass valve thermal sensor 92 mounted in the bypass valve 60 and can be activated to direct the fluid which is trapped by main poppet 64, to the low pressure area such as a tank 94 or pump inlet 22'. When the solenoid valve 86 is activated, the pump 10 is running at a low pressure bypass mode across the pump inlet 22' and discharge 24'. There is very little heat being generated, therefore, the pump 10 is able to keep running for a prolonged period of time at a very low pressure without overheating. Once the solenoid valve 86 closes, the discharge pressure of the pump 10 will return to normal and the pump 10 will resume its normal operation.

Figure 11:
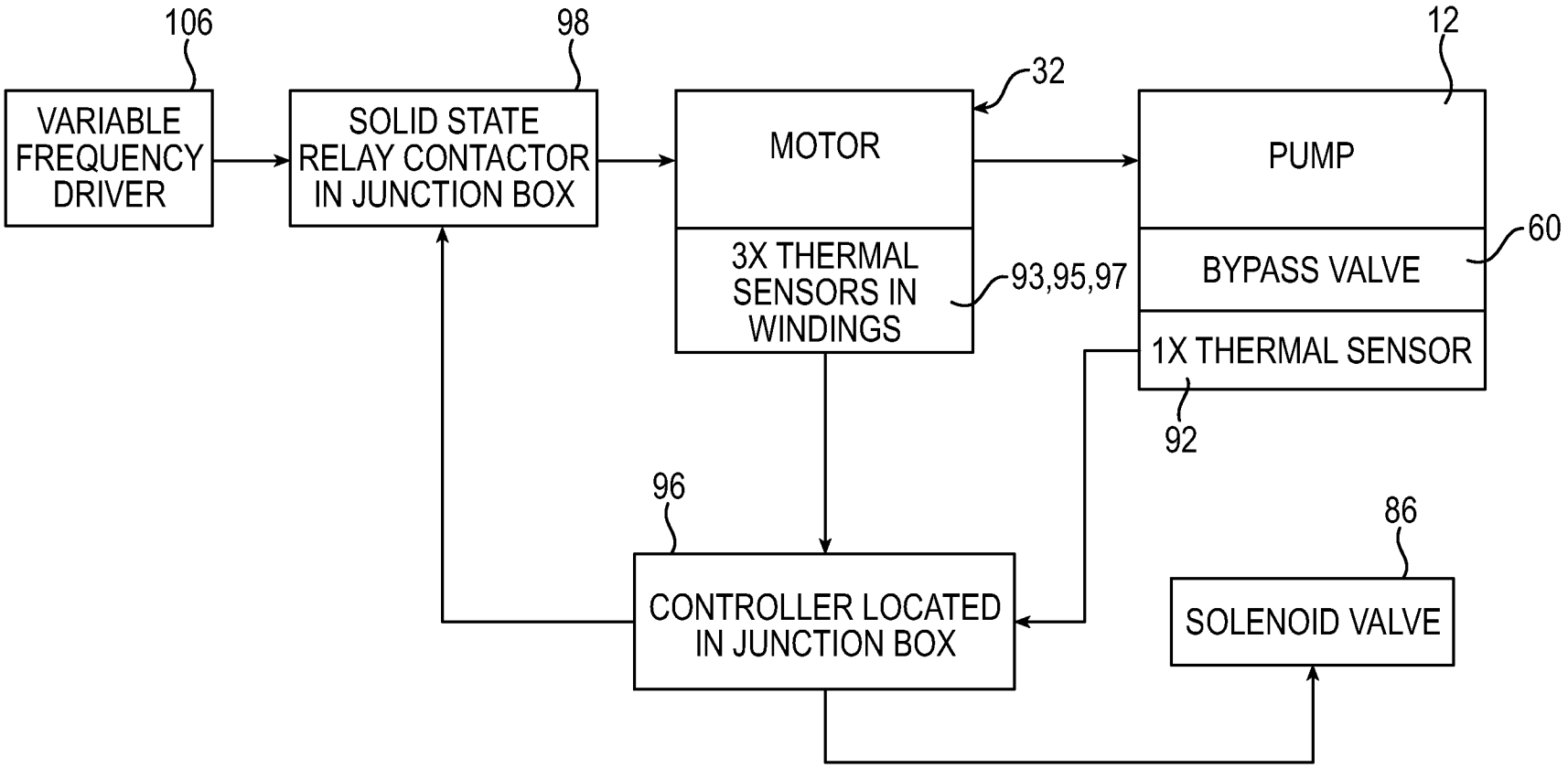
FIG. 11 is a flow chart showing the relationships of the parts of the thermal protection system of the pump assembly.
Figure 12A:
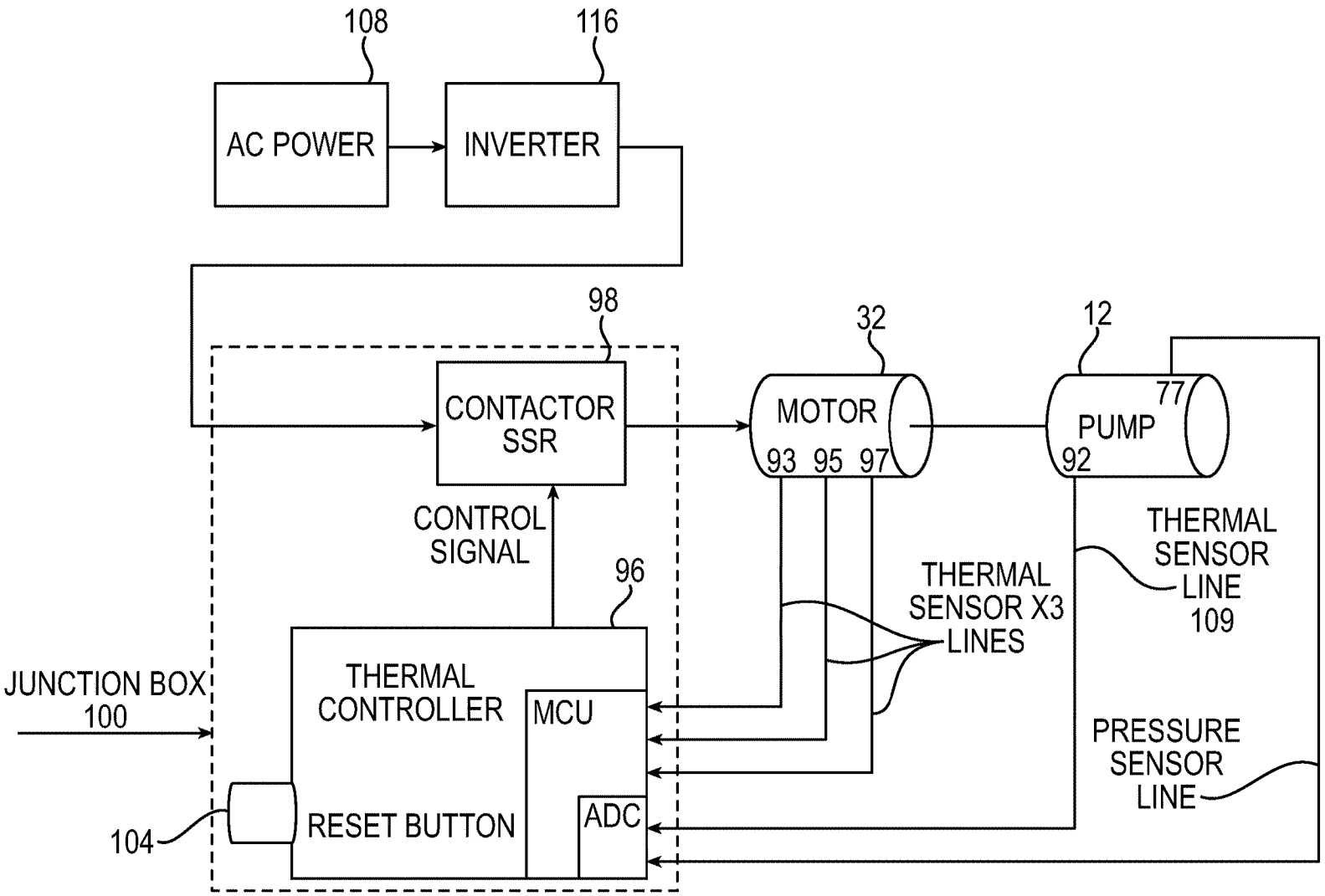
FIG. 12A is a flow chart showing operation of the junction box of the pump assembly shown FIG. 1 with the thermal sensors shown in the motor and pump.
Figure 12B:
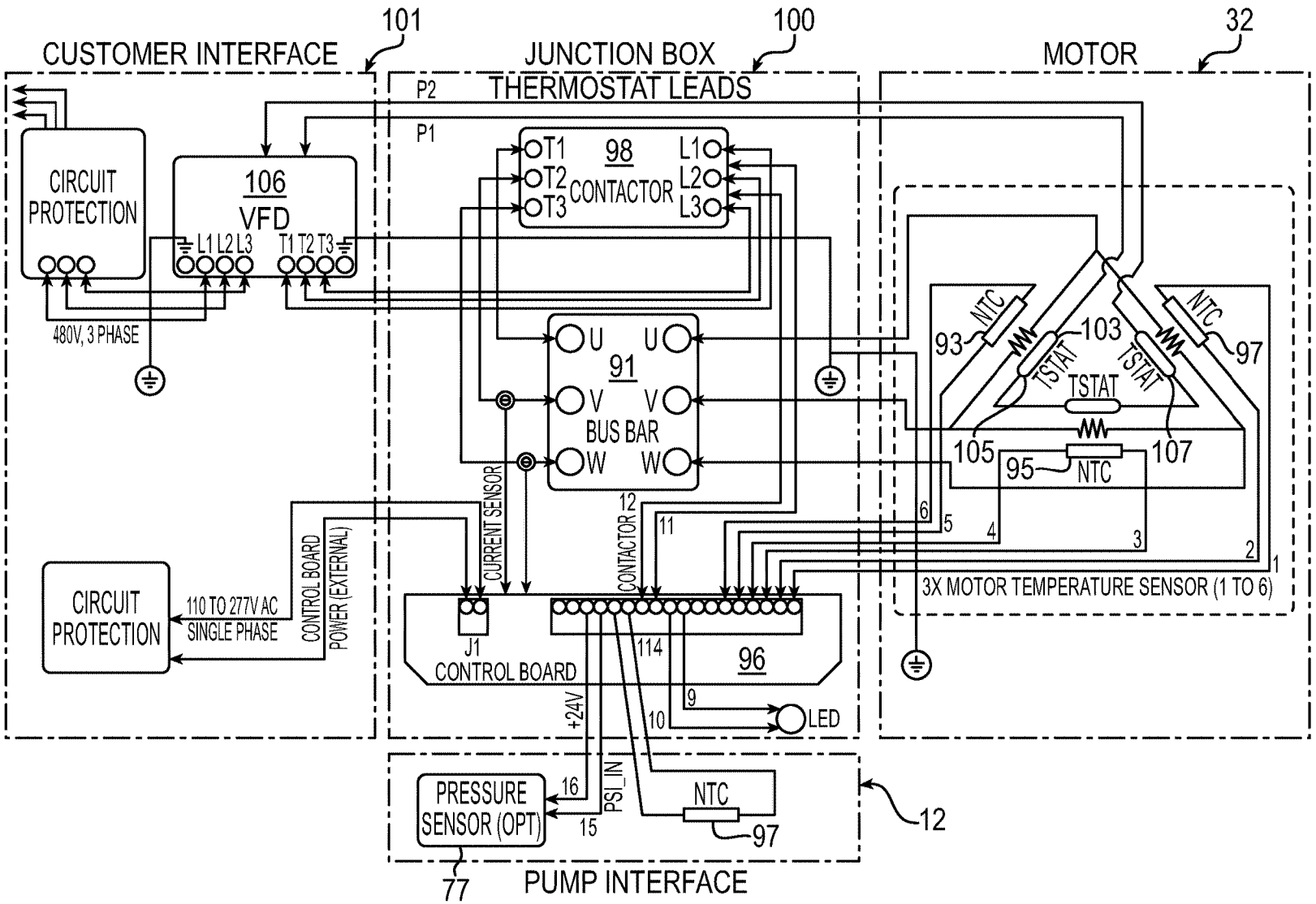
FIG. 12B is a schematic showing the connections between the junction box, motor, pump, and the user or customer interface.

Referring now to FIGS. 11, 12A, and 12B, it is noted that electric motors 32 that are run continuously and/or the operation of the bypass valve 60, results in the generation of a substantial amount of heat. Accordingly, the pump assembly 10 optionally comprises a thermal management, over current, and over pressure control system primarily housed in junction box 100 which is connected to motor 32 and lobe pump 12 and can work with customer/user interface 101. It integrates the protection of over temperature, over current and over pressure in one place and provides a redundant safety feature with the bypass valve 60. The junction box 100 contains elements including a solid state relay contactor 98, busbar 91, controller 96, reset button 104, and connecting wires. AC power 108 is run through an inverter 116, and then to the contactor 98. The contactor 98 then distributes the electric power to the motor 30 through the busbar 91.

The primary thermal protection comprises three temperature sensors 93, 95, 97 in the motor 32 which are imbedded in the motor windings, one in each phase. If the sensors 93, 95, 97 in the motor windings indicate that the predetermined motor operating temperature is exceeded, they will relay the signal to the controller 96 which will in turn activate the contactor 98 to cut the power. In one embodiment the predetermined temperature is set at 140° C. which is slightly below the Class F motor winding rating of 150° C. to prevent it from damage. The control of the primary thermal protection is fully contained within the junction box 100 attached to the motor 32.

An optional thermal and pressure protection system comprises a temperature sensor 92 and/or a pressure sensor 77. The bypass valve 60 generates tremendous heat when it is in bypass mode such that temperature sensor 92 may be positioned in the bypass valve 60 or in the lobe gear pump 12. If the temperature rises out of the predetermined operating range, the bypass valve thermal sensor 92 will transmit the signal directly to the contactor 98 located in the junction box 100 which will shut off the motor 32. Similarly, if the pressure detected by the pressure sensor 77 in the bypass valve 60 rises above a predetermined pressure, then the controller 96 will shut down the motor 32. In configurations that do not utilize bypass valve 60, the pressure sensor 77 and/or thermal sensor 92 can be positioned in the lobe gear pump 12 or any other appropriate location.

Current protection is provided by the contactor 98 inside the junction box 100 The mechanical contactor 98 is rated at a predetermined level for a particular sized motor (i.e. 75 amps for 20 hp motor, 100 amps for 30 hp motor, and other appropriate ratings for different sized motors). When the input current reaches this predetermined level, the contactor 98 will cut off the current to the motor 32 essentially serving as a fuse. The contactor 98 will need to be replaced to restart the motor 32 and accordingly is not used as the primary means for thermal or over current protection.

Another level of protection is optionally provided by a thermal sensing line comprising three NC (normally close) thermostats 103, 105, 107 positioned in the motor windings in series, one in each phase. The thermostats 103, 105, 107 are connected to the Variable Frequency Drive (VFD) 106 to cut off the current if needed. The VFD can also be pre-programmed to set a predetermined maximum current limit of each phase of motor to provide over current protection.

The operation of the pump assembly 10 in a typical application of fluid transport would proceed as follows: the fluid is taken in from a tank or hose through the inlet 56 to the centrifugal pump 14 and given an inlet pressure boost via rotation of the impeller 64 as driven by the drive motor 32 through drive shaft 34. The fluid is collected in the impeller volute and rerouted to the lobe gear pump housing inlet 22. The fluid, now with a boost of inlet pressure, then gets pumped through the lobe gear rotors 26, 28 where it enters a high volume cavity in the lobe gear pump chamber 20 and is pumped outward through the outlet 24 of the lobe gear pump housing 18 to discharge into the system.

Figure 13:
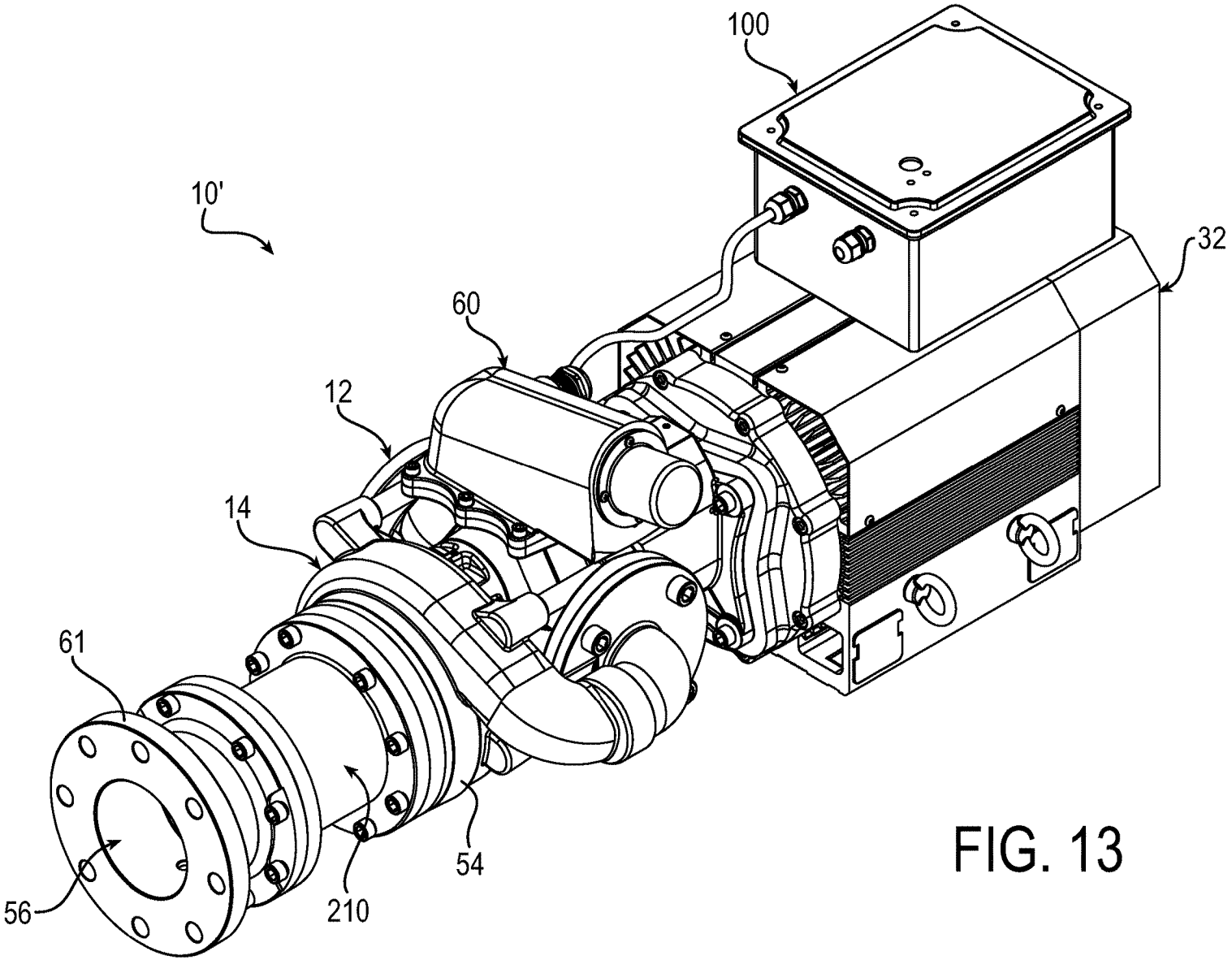
FIG. 13 is a perspective view of another embodiment of the pump assembly of the present invention including an inducer section.
Figure 14:
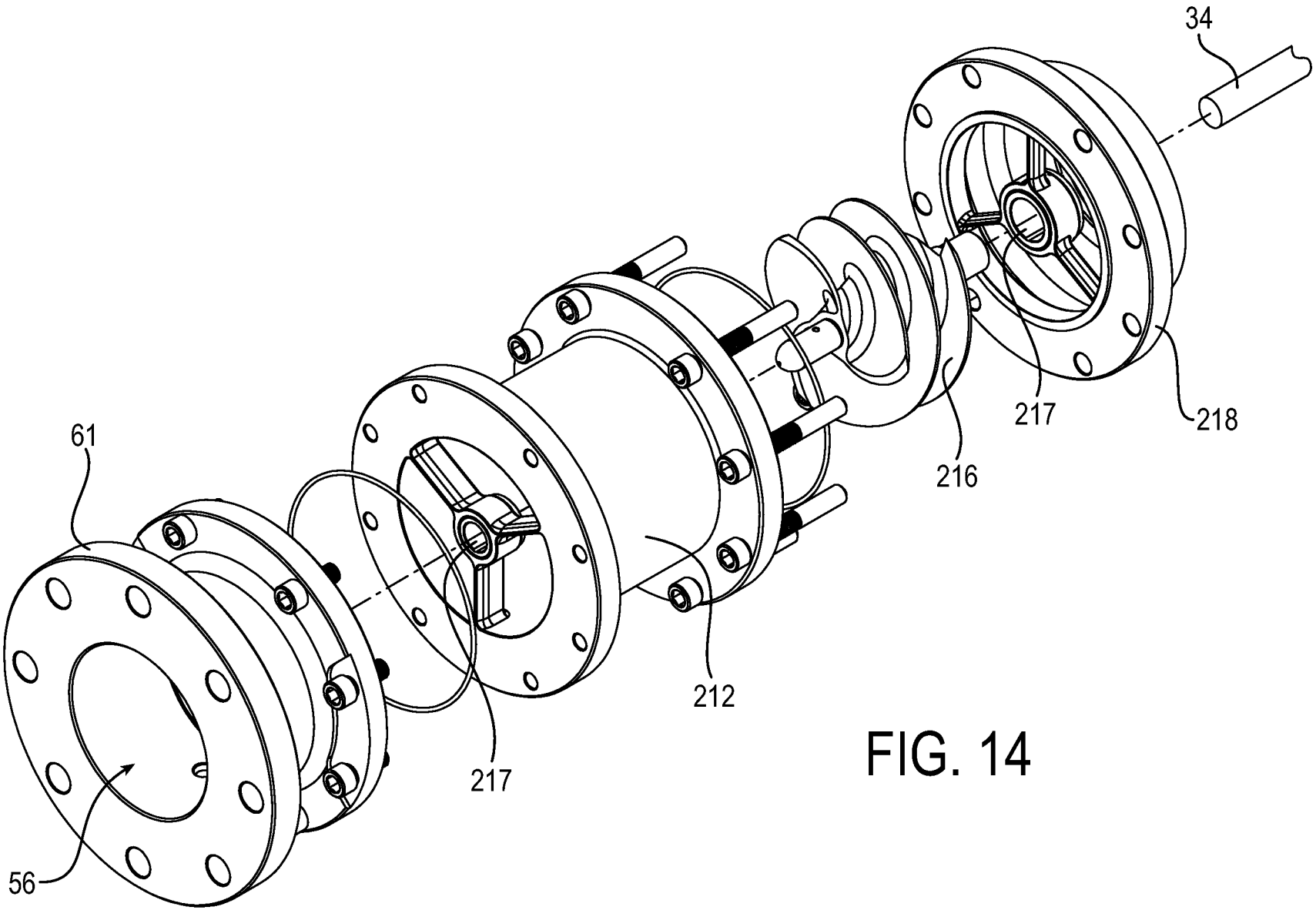
FIG. 14 is an exploded perspective view of the inducer section and inlet of the pump assembly shown in FIG. 13.

Referring now to FIGS. 13-14, another embodiment of the lobe gear pump assembly 10' utilizes an inducer assembly 210 placed between the impeller inlet 56 having flange 61 and the impeller assembly 14 for high vapor applications. The inducer assembly 210 comprises an inducer housing or cover 212, an inducer 216, and an inducer back 218. High volatility fluids may vaporize during pumping wherein the eventual collapse of the vapor bubbles will create cavitation that can severely damage the pump components. The inducer assembly 210 provides a pre-boost of the inlet pressure and compresses the gas or vapor in the incoming fluid. The inducer assembly 210 serves to fully condition the fluid of all vapor bubbles due to the inlet pressure boost. The long fluid channel of the inducer 216 imparts kinetic energy to the fluid which is borne as potential energy or pressure. The inducer 216 is mounted on and coupled to the drive shaft 32 or is driven by the drive shaft. The inducer 216 may include carbon bushings 217 or other appropriate known materials or bearings to allow the inducer to dry run without building up heat. The fluid, now compressed, has a high velocity as well as a higher pressure. Increasing the pressure of the fluid prevents the expansion of the gas bubbles and potential damage to the pump assembly 10'.

Figure 15:
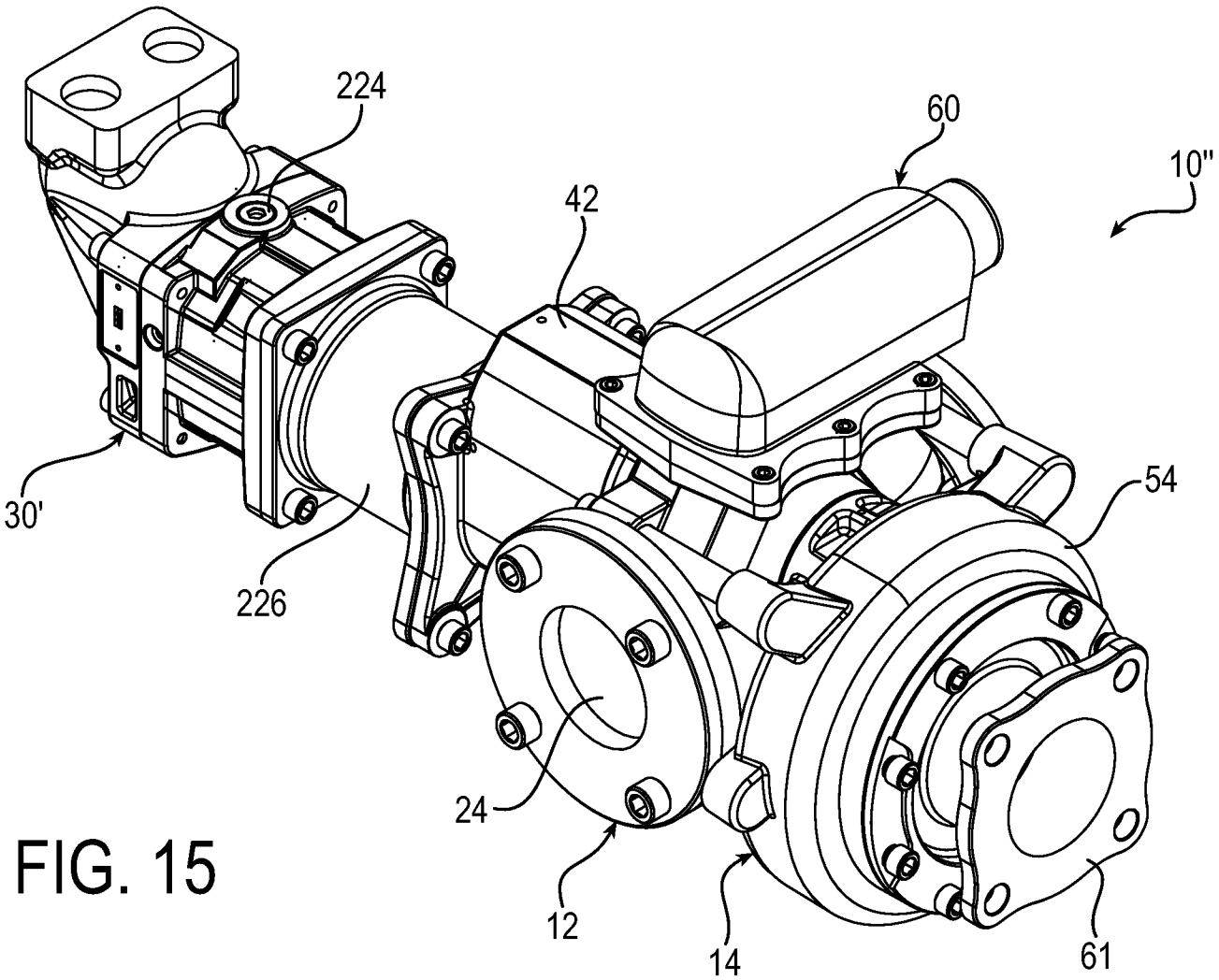
FIG. 15 is a perspective view of a pump assembly that utilizes a hydraulic motor.
Figure 16:
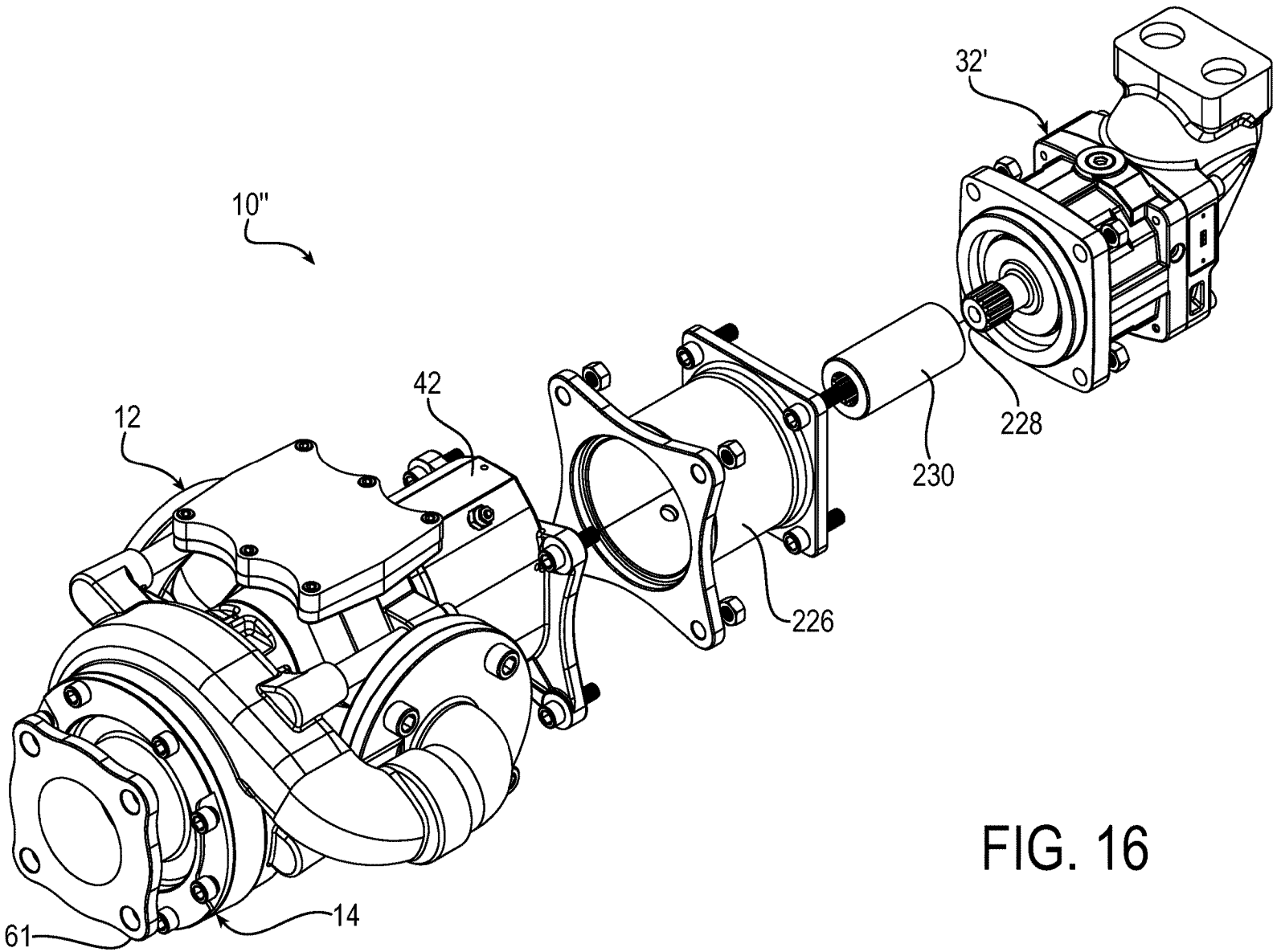
FIG. 16 is an exploded perspective view of the pump assembly shown in FIG. 15.
Figure 17:
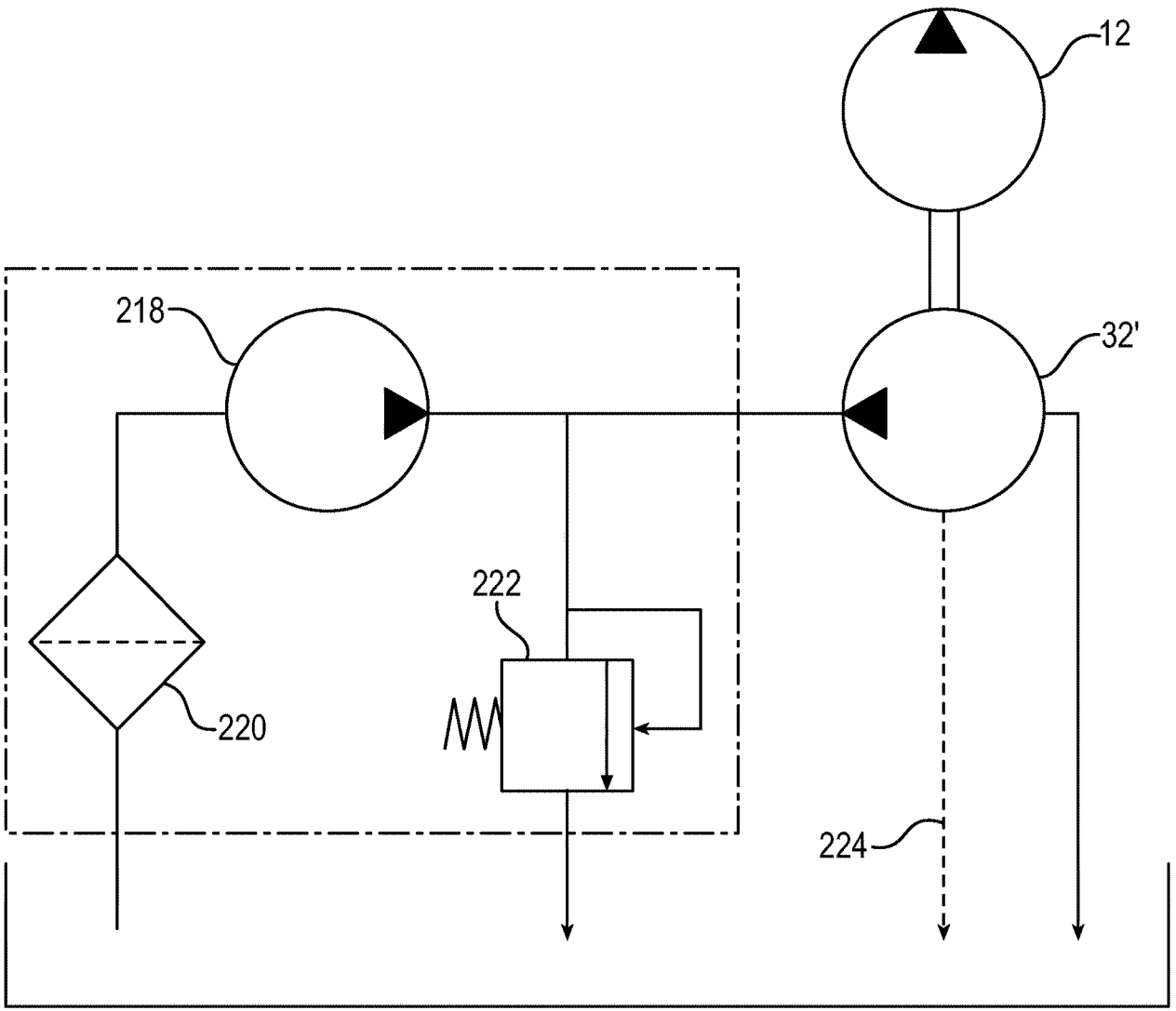
FIG. 17 is a hydraulic schematic of another embodiment of the pump assembly that utilizes a hydraulic motor.

In another embodiment of the pump assembly 10" of the invention as shown in FIGS. 15-16, the motor is shown as a hydraulic motor 32'. The hydraulic motor 32', shown as but not limited to a bi-directional bent axis hydraulic motor, is attached to the timing gear housing 42 by a coupling manifold 226 which covers a coupling 230 that drivingly couples hydraulic pump shaft 228 to the drive shaft (not shown) of the lobe gear pump 12. It is also noted that the pump 10" shown in FIG. 16 does not include a bypass valve. As shown schematically in FIG. 17, the hydraulic motor 32' receives fluid from hydraulic pump 218 which in a typical application would be mounted on a tanker truck and run by a power take off of the truck transmission. The hydraulic motor 32' may include drain port 224. The hydraulic pump 218 may include an inlet filter 220 and a pressure relief valve 222. Apart from the hydraulic motor 32' (and coupling 230/coupling manifold 226) in place of the electric motor 32 (and control box 100), the remainder of the pump assembly 10" is generally same as any of the previous embodiments 10', 10.

Figure 18:
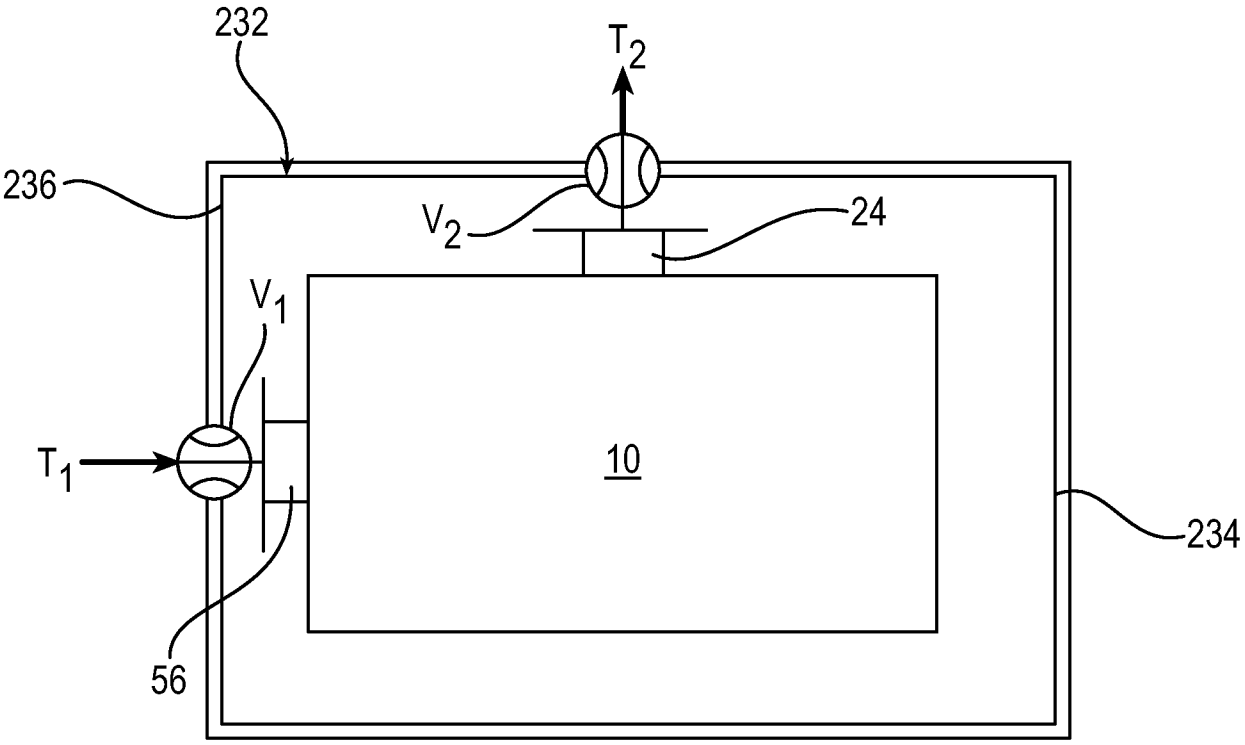
FIG. 18 is a schematic of another embodiment of the pump assembly that utilizes a reversible flow configuration with fluid flow shown in a forward direction.
Figure 19:
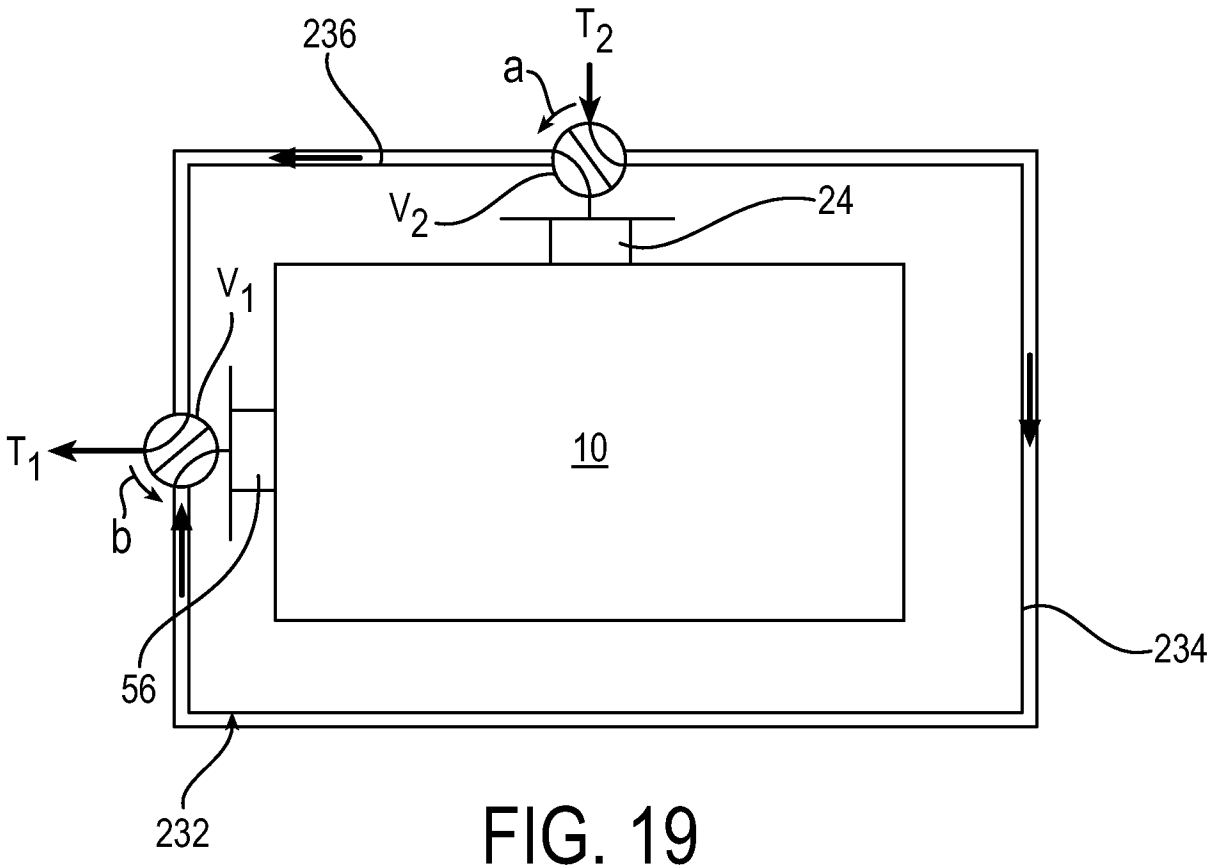
FIG. 19 is a schematic of another embodiment of the pump assembly that utilizes a reversible flow configuration with fluid flow shown in a reverse direction.
Figure 20:
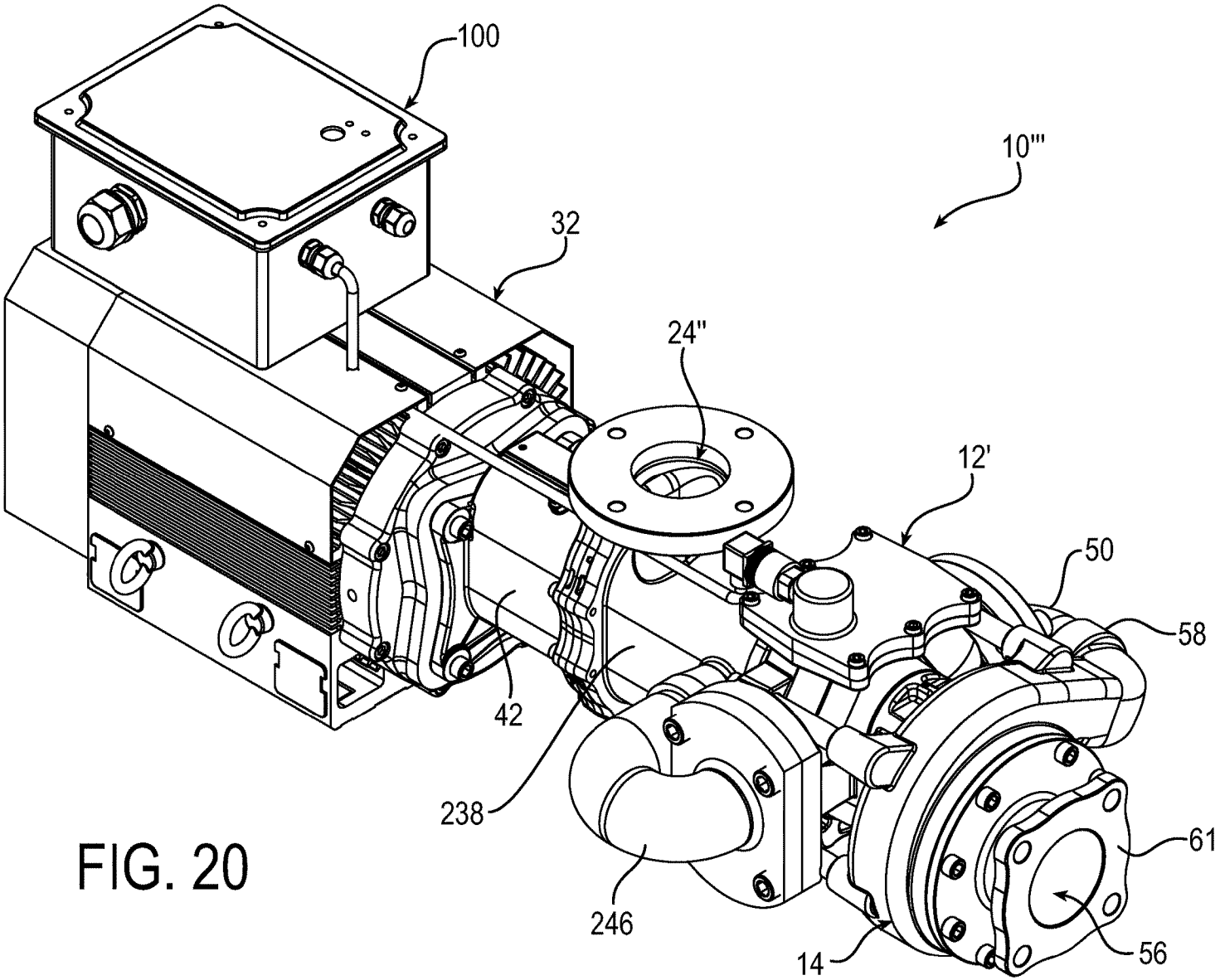
FIG. 20 is a perspective view of another embodiment of the pump assembly that utilizes reverse flow inducers.
Figure 21:
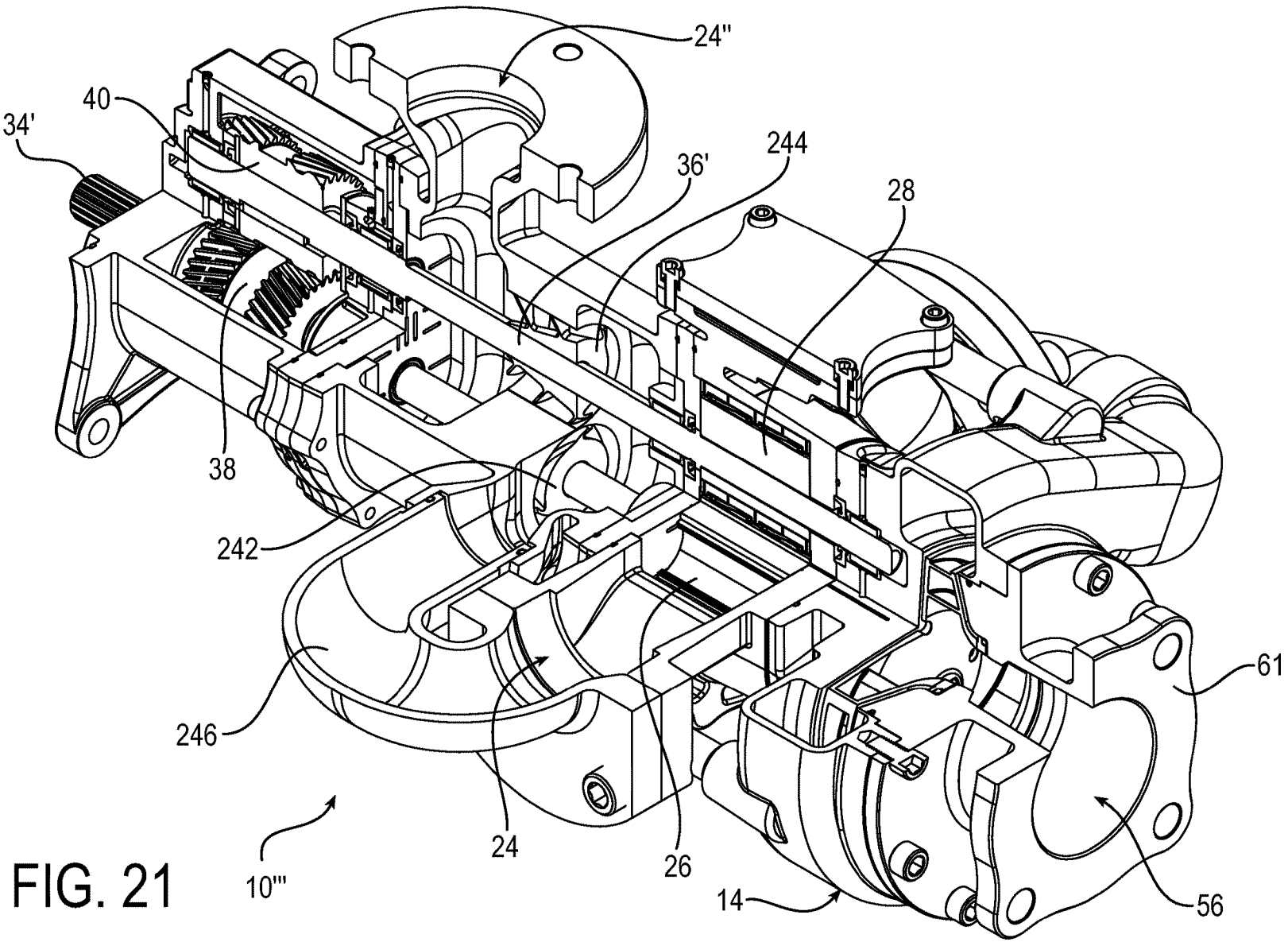
FIG. 21 is a partial sectional perspective view of the pump assembly of FIG. 20.
Figure 22:
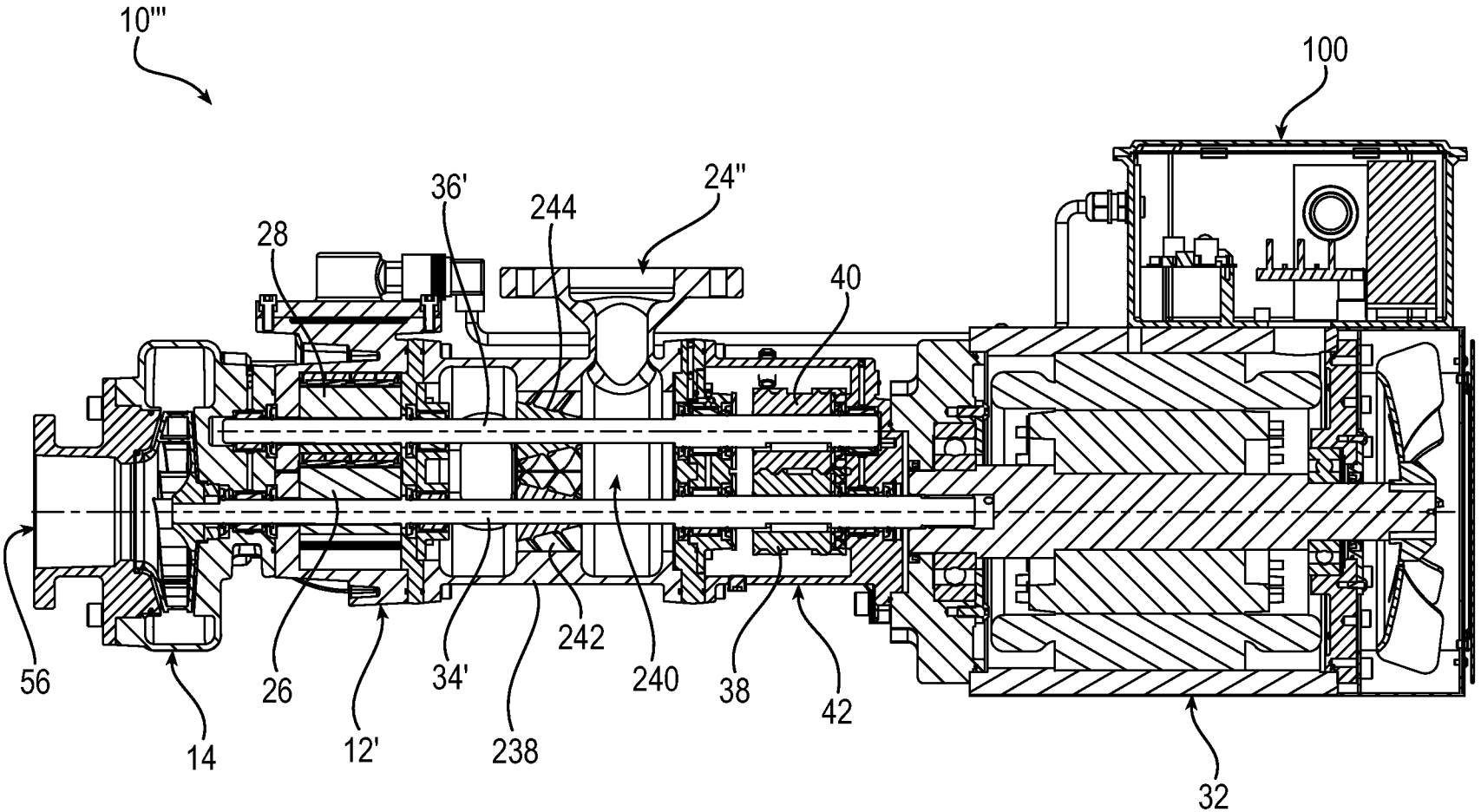
FIG. 22 is a sectional side view of the pump assembly of FIG. 20 taken along a longitudinal centerline.
Figure 23:
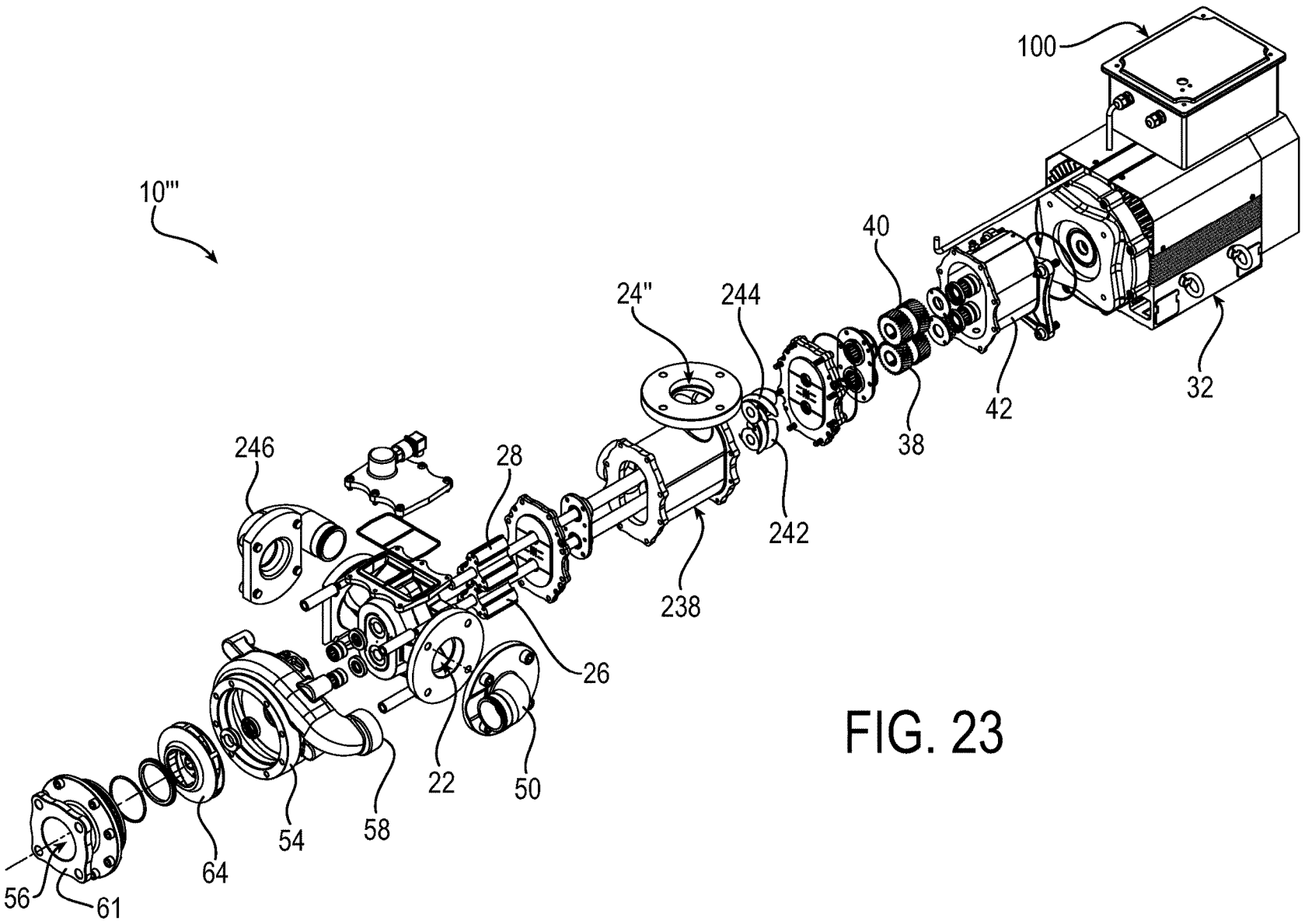
FIG. 23 is an exploded perspective view of the pump assembly shown in FIG. 20.

Although the pump assembly 10, 10', and 10" is reversible, the pump is optimized for high speed flow in a single direction. Running the pump assembly 10, 10', and 10" in reverse may result in a loss of flow rate efficiency typically in the range of 15-35%. This can be a significant issue for users who want to transfer fluid in both directions, i.e. a tanker truck operator that unloads and loads fluid into the tank. It is possible to utilize valves to maintain the flow in a single optimized direction through the pump assembly 10 (which includes configurations 10' and 10") as shown in FIGS. 18 and 19. A reversing system 232 comprises a first valve V1, a second valve V2 and a first bypass passage 234 and a second bypass passage 236. During normal operation, the flow from source tank T1 flows through first valve V1 to the inlet 56 of the pump assembly 10 and is discharged through pump assembly outlet 24 and through the second valve V2 to destination tank T2. When the flow direction needs to be reversed, the valves V1 and V2 are rotated as shown at a, b such that the second valve V2 directs flow from the destination tank T2 through first bypass passage 234 to the first valve V1 which directs flow to the inlet 56 of the pump assembly 10 and is discharged through outlet 24 and through the second valve V2 which directs the flow through second bypass passage 236 to valve V1 and on to source tank T1. Using the reversing system 232, the pump 10 is always pumping from inlet 56 to outlet 24. This enables the pump 10 to operate in a single direction which utilizes the impeller 64 of the centrifugal pump 14 (and inducer 216 in pump 10") which enables high speed flow through the lobe gear pump 12.

In some applications, a user may want to utilize a reversible pump without a reversing system 232. A reversible pump assembly 10"" as shown in FIGS. 20-23, the pump assembly is similar to pump assembly 10 except that the flow is directed from the outlet 24 of the lobe gear pump 12' to an inducer chamber 240 within an inducer housing 238 positioned between the lobe gear pump 12' and the timing gear housing 42. Within the inducer chamber 240, inducers 242 and 244 are respectively mounted and driven by shafts 34', 36'. The inducers 242, 244 are formed such that when the pump 10'" is run in reverse, the inducers pressurize fluid entering the inducer chamber 240 through the inducer chamber outlet port 24". The pressurized fluid is then fed into the lobe gear pump outlet 24 via fluid passageway 246. The lobe gear pump 12', running in reverse, pumps the fluid out through inlet port 22, elbow 50, centrifugal pump 14 and out the pump inlet 56. Similar to the inducer 216 of pump assembly 10', the inducers 242, 244 allow the lobe gear pump 12' to run faster by preventing cavitation at the increased speeds.

Figure 24:
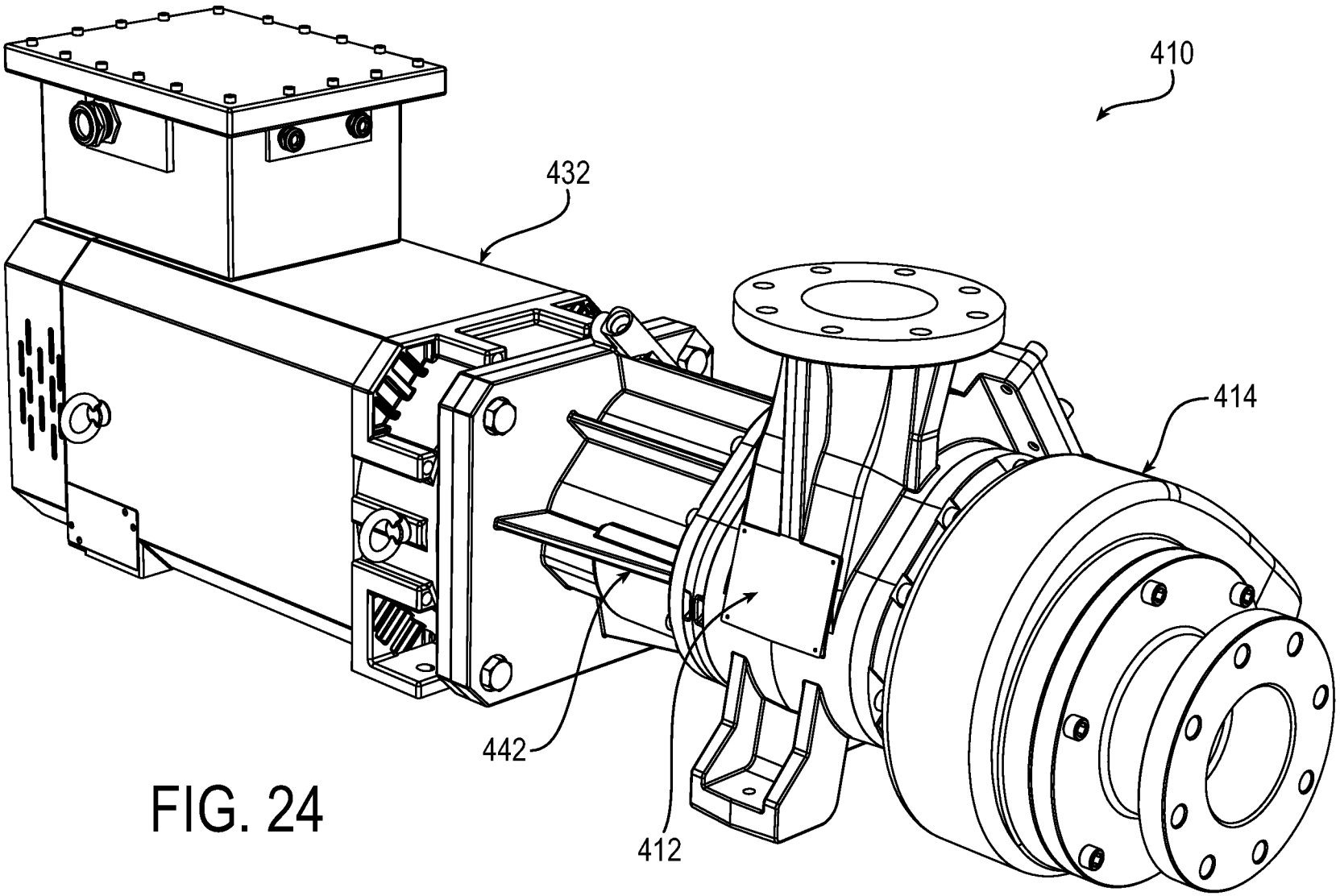
FIG. 24 is a perspective view of another embodiment of the pump assembly.
Figure 25:
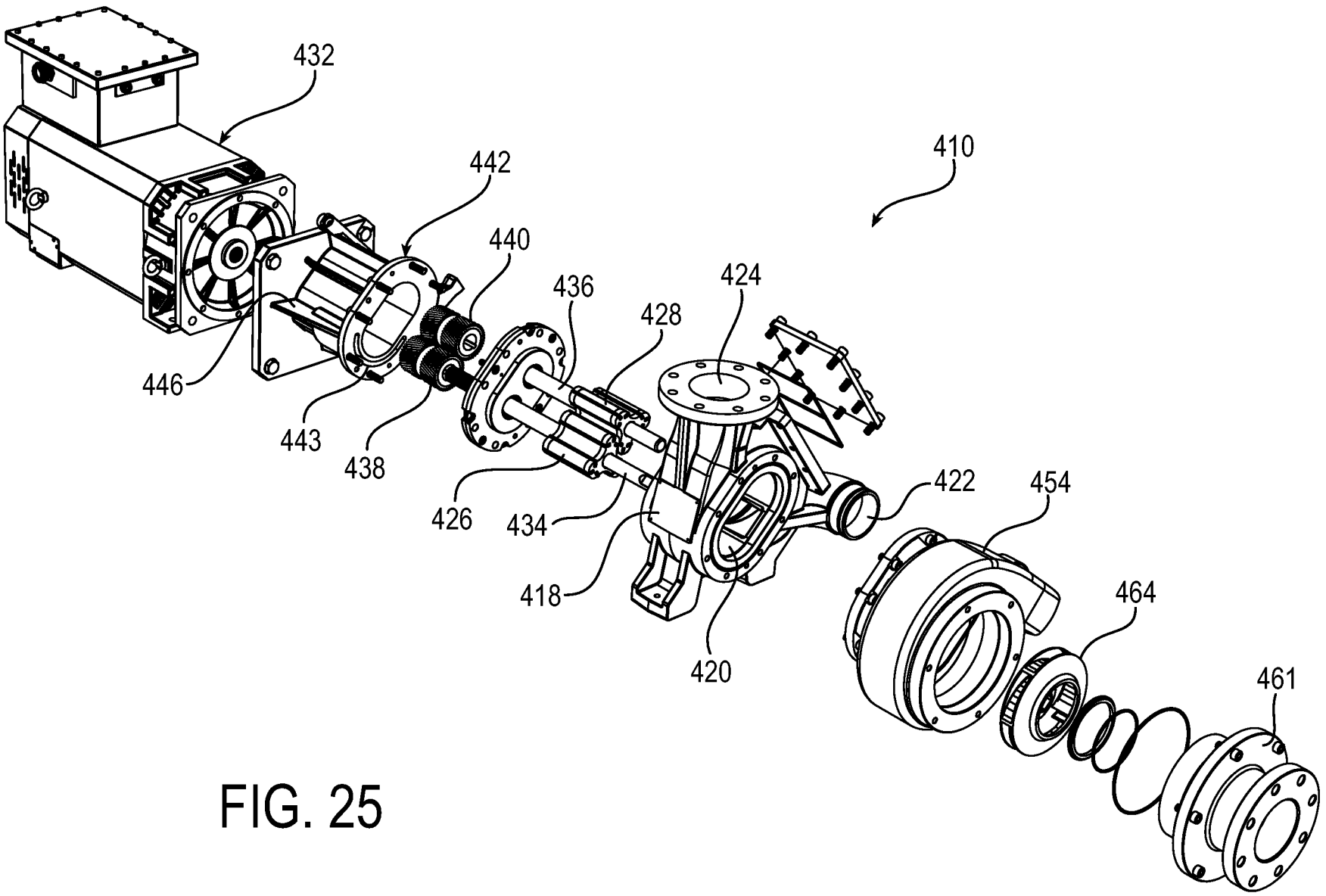
FIG. 25 is an exploded perspective view the pump assembly of FIG. 24.
Figure 27:
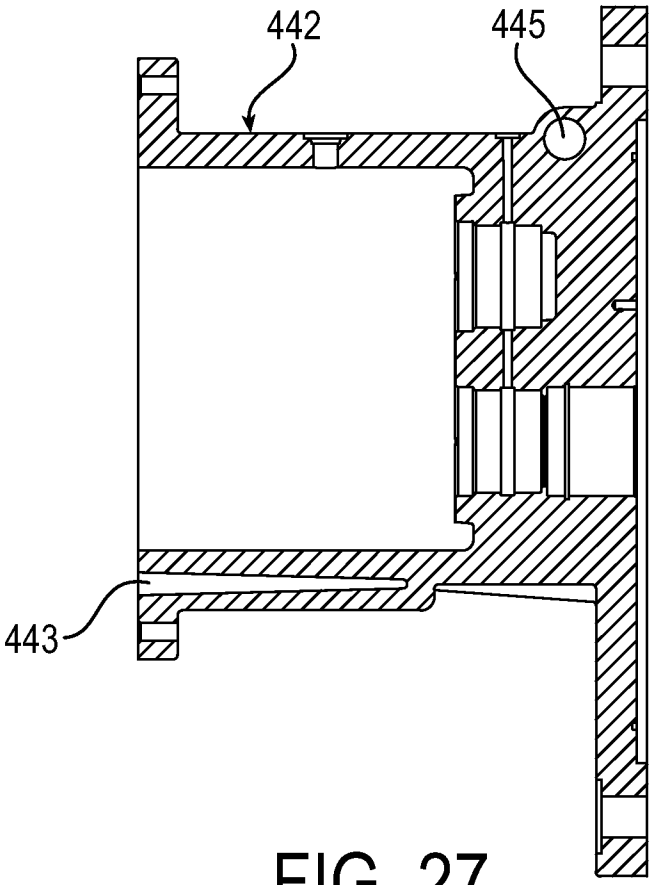
FIG. 27 is a sectional side view of the timing gear housing of FIG. 26 taken along a longitudinal centerline.
Figure 26:
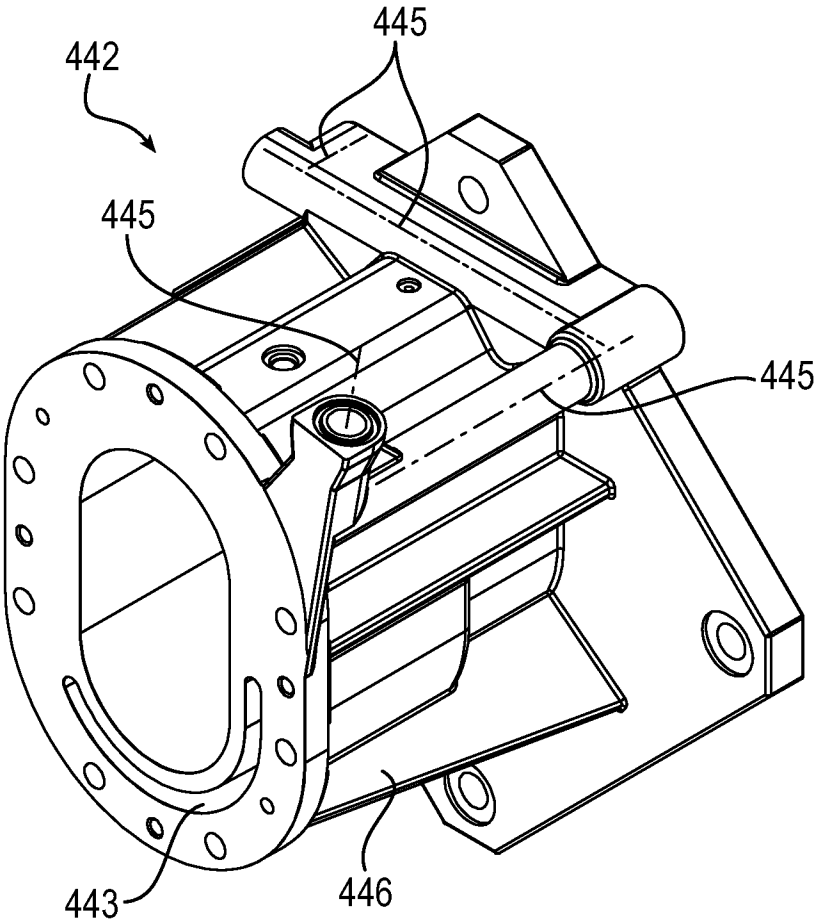
FIG. 26 is a perspective view of the timing gear housing of the pump assembly shown in FIG. 24.
Figure 28:
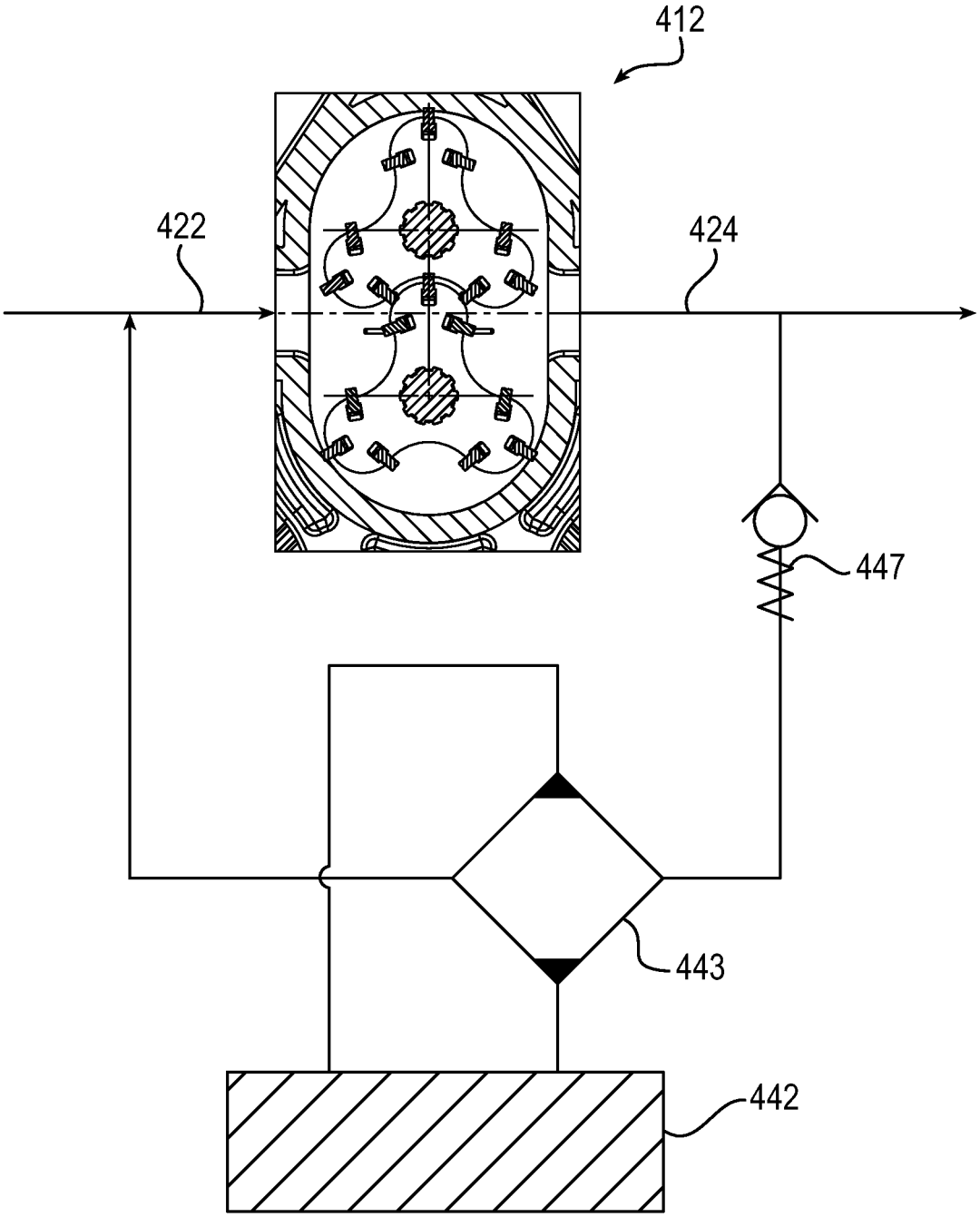
FIG. 28 is schematic view of a cooling feature associated with the timing gear housing of the pump assembly shown in FIG. 24.

Larger pump assemblies may require additional features. FIGS. 24-25 illustrate another embodiment of the pump assembly 410 of the invention shown in various views as described above. The pump assembly 410 comprises a lobe gear pump 412 and a centrifugal pump 414. The centrifugal pump 414 comprises a centrifugal pump housing 454 having an impeller 464 and inlet flange 461. The lobe gear pump 412 comprises a first housing (also referred to as a lobe gear housing) 418 having an interior chamber 420 between an inlet or suction port 422 and an outlet or discharge port 424. The lobe gear pump 412 further comprises a first rotor assembly 426 and a second rotor assembly 428 rotatably housed within the interior chamber 420 of the lobe gear housing 418. The pump assembly 410 may further include a drive motor 432 shown herein as an AC motor having a junction box 400 attached thereto. While motor 442 is shown as an AC motor, any suitable drive motor such as a hydraulic motor or DC motor is contemplated. The drive motor 432 drives a first drive shaft 434 which counter rotatingly drives a second driven shaft 436 through a pair of timing gears 438, 440 each mounted on a respective shaft 434, 436 and housed in a timing gear housing 442. The timing gear housing 442 is secured to the housing of the motor 432 on one end and secured to the lobe gear housing 418 on the other end thereof. The timing gears 438, 440 may be made of any suitable material such as an alloy steel. The timing gears 438, 440 lie within an oil bath in the timing gear housing 442 in order to operate quietly and efficiently. With larger size motors 432, the heat from the motor and the heat generated from the timing gears can significantly elevate the temperature within the timing gear housing 442. In order to help cool the timing gear housing 442, the timing gear housing 442 has external cooling fins 446 and an internal cooling chamber 443 as shown in FIGS. 25-27. Referring now to FIG. 28, a schematic drawing shows a portion of the fluid being pumped by the lobe gear pump 412 is redirected from the outlet 424 through one way check valve 447 to the internal cooling chamber 443 where heat is transferred to the fluid which flows from the internal cooling chamber 443 to the inlet of the lobe gear pump 412. As best shown in FIGS. 26 (dashed line) and 27, the timing gear housing 442 includes a conduit 445 that the wires for a temperature and/or a pressure sensor (not shown) may pass through to minimize exposure of the wires.

Larger lobe gear pumps require larger rotors which may be cost prohibitive to manufacture from a PEEK or other similar engineered plastic material than enables the dry run capability of pump assembly 10. The rotor assemblies 426, 428 of pump assembly 410 are made of a body 427 of a suitable metallic material such as aluminum. The ends 429 of the body 427 are formed undersized with a slot 431 formed therein as best shown in FIG. 29. The ends 429 of the body 427 are overmoulded with an engineering plastic, such as PEEK, and machined to form ends 433 of rotor assemblies 426, 428 as shown in FIG. 30. In operation of the pump assembly 410, the rotors 426, 428 are positioned and timed so that the metallic rotor profiles do not touch each other nor do they rub against the lobe gear housing 418. The ends of the rotors 426, 428 do rub up against the housing 418. The engineering plastic ends 433 act as wear plates on both sides of rotors 426, 428 to avoid metal to metal contact. Having the engineering plastic ends 413 helps enable the pump assembly 410 to continuously dry run.

In addition to being able to run at high speed and to produce high flow rates, the lobe gear pump assembly of the present invention provides an advantage over prior art lobe gear pump assemblies in terms of footprint size, adjustability, pressure and thermal sensor setup, reverse flow and the ability to dry run continuously. The lobe gear pump assembly is roughly 40% smaller and lighter when compared to other pumps. The lobe gear pump assembly is unique in the fact that both its motor sensors and bypass valve sensors are linked to the same control circuit. This is a benefitting design that allows for effective communication between the motor and pump operations, establishing self-regulation. Furthermore, the pilot-operated relief valve of the lobe gear pump assembly can be easily adjusted externally. Most other products on the market use a direct acting relief valve which is not easily adjustable and requires a much more stiff spring force.

Although the principles, embodiments and operation of the present invention have been described in detail herein, this is not to be construed as being limited to the particular illustrative forms disclosed. They will thus become apparent to those skilled in the art that various modifications of the embodiments herein can be made without departing from the spirit or scope of the invention.

The invention claimed is:

1. A pump assembly comprising:

a lobe gear pump having a first housing having an interior chamber, an inlet, an outlet that forms the outlet for the pump assembly through which fluid is discharged from the pump assembly, a first rotor and a second rotor, each rotor having a plurality of lobes, the first rotor and second rotor rotatable within the interior chamber of the first housing, and a wiper insert interconnected to each of the plurality of lobes of each rotor, each wiper insert being depressibly radially biased outward from the lobe of the corresponding first or second rotor such that the wiper can contact the at least one of the other rotor and the interior chamber of the first housing upon rotation of the rotors;

a timing gear set associated with the first and second rotor which causes the rotors to mesh upon rotation without contacting each other;

a centrifugal pump having a second housing attached to the first housing and having an interior chamber, an inlet, and an outlet fluidly connected to the inlet of the first housing, and an impeller rotatable within the interior chamber of the second housing; and a pump inducer assembly having a third housing attached to the second housing and having an interior chamber fluidly connected to the inlet of the centrifugal pump and an outlet, the outlet of the third housing fluidly connected to the inlet of the second housing, and an inducer rotatable within the interior chamber of the third housing, wherein the pump assembly has one flow path in which an amount of fluid is taken into the pump assembly and the same amount of fluid flows from the inducer assembly downstream to the centrifugal pump, from the centrifugal pump downstream to the lobe gear pump, and is discharged through the outlet of the lobe gear pump.

2. The pump assembly according to claim 1, wherein a centerline through the inlet and the outlet of the first housing is perpendicular to the inlet of the second housing.

3. The pump assembly of claim 1 further comprising:

a drive motor;

a first drive shaft driven by the drive motor in a first direction or a second direction;

a first timing gear of the timing gear set, the first rotor, and the impeller mounted on and coupled to the first drive shaft;

a second timing gear of the timing gear set driven by the first timing gear, the second timing gear and the second rotor mounted on and coupled to a second driven shaft.

4. The pump assembly of claim 3, wherein a centerline of the inlet of the centrifugal pump is collinear with a centerline of the first drive shaft.

5. The pump assembly according to claim 3, wherein the inducer is rotatingly coupled to the first drive shaft.

6. The pump assembly according to claim 5 further comprising a second inducer mounted on and coupled to the second driven shaft, the inducers configured to pressurize fluid and direct the fluid to the lobe gear pump outlet when the drive motor is rotating the first drive shaft in the second direction.

7. The pump assembly according to claim 1, wherein each wiper insert is biased by a spring formed from a continuous band of metal strip, each spring having a pair of arms extending from a base portion of the spring and crossing each other at a midpoint of each arm.

8. The pump assembly according to claim 7, wherein the arms are each extending from opposite sides of the base portion at an acute angle with the base portion, the metal strip having a first width and a second width smaller than the first width, the base portion and each end of the metal strip formed at the first width and a portion of each arm portion formed at the second width, the arms crossing each other such that the arms form an "X".

9. The pump assembly according to claim 1, further comprising:

an externally adjustable pilot operated bypass valve mounted on the first housing which allows fluid to flow from an outlet of the interior chamber of the first housing to an inlet of the interior chamber of the first housing when a predetermined outlet pressure is achieved.

10. The pump assembly according to claim 1, wherein at least a portion of each rotor is made of a metallic material and at least an end portion of each rotor is made of a plastic material.

11. The pump assembly according to claim 1, further comprising:

a first valve and a second valve, each valve having a first position and a second position, the first valve attached to an inlet of the of the second housing and the second valve attached to the outlet of the lobe gear pump;

the first valve and the second valve connected to each other by a first passageway and a second passageway;

wherein when the first valve and the second valve are both in the first position, the pump assembly draws fluid through the first valve, through the pump assembly to the second valve;

wherein when the first valve and the second valve are both in the second position, the pump assembly draws fluid through the second valve which directs fluid through the first passageway to the first valve which directs fluid through the pump assembly to the second valve which directs fluid through the second passageway to the first valve.

12. The pump assembly according to claim 1, further comprising:

a control system communicatively coupled to the motor and including a temperature sensor and/or a pressure sensor arranged in the pump assembly, the control system being configured to turn off the motor when either the temperature sensor indicates a temperature above a predetermined temperature threshold or the pressure sensor indicates a pressure above a predetermined pressure threshold.

13. The pump assembly according to claim 1 further comprising:

a drive motor wherein the drive motor is an electric motor or a hydraulic motor.

14. The pump assembly according to claim 1, further comprising:

a timing gear housing positioned between the drive motor and the first housing, the timing gear housing having a timing gear chamber at least partially filled with lubricant;

an internal cooling chamber formed in the timing gear housing;

wherein a portion of a fluid being pumped by the lobe gear pump is redirected from the outlet of the lobe gear pump to the internal cooling chamber where heat is transferred from the timing gear housing to the fluid which flows from the internal cooling chamber to the inlet of the lobe gear pump.

15. The pump assembly according to claim 1, further comprising:

a timing gear housing positioned between the drive motor and the first housing, the timing gear housing having a plurality of cooling fins formed on an exterior surface of the timing gear housing.

16. The pump assembly according to claim 1 further comprising an elbow flange connecting member fluidly connected between the outlet of the centrifugal pump and the inlet of the lobe gear pump.

* * * * *